US012618229B2

(12) United States Patent
Fukuda

(10) Patent No.: US 12,618,229 B2
(45) Date of Patent: May 5, 2026

(54) WORKING VEHICLE AND ATTACHMENT USAGE SYSTEM

(71) Applicant: Kubota Corporation, Osaka (JP)

(72) Inventor: Yuji Fukuda, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 86 days.

(21) Appl. No.: 18/760,998

(22) Filed: Jul. 1, 2024

(65) Prior Publication Data

US 2026/0002344 A1 Jan. 1, 2026

(51) Int. Cl.
*E02F 3/00* (2006.01)
*E02F 3/36* (2006.01)
*E02F 9/26* (2006.01)

(52) U.S. Cl.
CPC ..... *E02F 9/265* (2013.01); *E02F 3/3604* (2013.01)

(58) Field of Classification Search
None
See application file for complete search history.

(56) References Cited

U.S. PATENT DOCUMENTS 8,521,371 B2 * 8/2013 Faivre ..... G05B 19/106 701/50
11,698,086 B2 * 7/2023 Froemming ..... E02F 9/2228 701/50
11,718,509 B2 * 8/2023 Lyngbäck ..... B66C 13/48 701/50
2010/0185335 A1 * 7/2010 Sawada ..... E02F 3/3622 700/282
2014/0067215 A1 * 3/2014 Wetterlund ..... G06F 17/00 701/69
2016/0312432 A1 * 10/2016 Wang ..... E02F 9/265
2017/0300040 A1 * 10/2017 Butler ..... E02F 9/265
2019/0024345 A1 * 1/2019 Thomsen ..... E02F 9/2029
2019/0248007 A1 * 8/2019 Duffy ..... B25J 9/1653
2019/0301131 A1 * 10/2019 Hendron ..... E02F 9/265
2021/0132577 A1 * 5/2021 Matzelle ..... H04Q 9/00
2021/0402932 A1 * 12/2021 Garcia ..... A01B 59/00
2022/0412040 A1 12/2022 Zitterbart et al.
2023/0150139 A1 * 5/2023 Debusca ..... B25J 11/008 700/258
2024/0093468 A1 * 3/2024 Deguchi ..... E02F 9/268
(Continued)

*Primary Examiner* — James M Mcpherson
(74) *Attorney, Agent, or Firm* — Keating & Bennett, LLP

(57) ABSTRACT

A working vehicle includes a hitch to attach and detach an attachment thereto and therefrom, a receiver to receive wireless signal(s) which are transmitted periodically from transmitter(s) in or on the attachment(s), which include respective piece(s) of identification information of the attachment(s), and which are compliant with a near field communication standard, and a controller. The controller is configured or programmed to perform a selecting process and a predetermined process when the attachment is attached to the hitch and when a predetermined switch is operated with the attachment attached to the hitch, the selecting process including selecting, according to a predetermined condition, one of the piece(s) of identification information that is included in one of the wireless signal(s) received by the receiver, the predetermined process corresponding to the one of the piece(s) of identification information selected in the selecting process.

17 Claims, 23 Drawing Sheets

(56) References Cited

U.S. PATENT DOCUMENTS

| | | | | |
|---|---|---|---|---|
| 2024/0117608 | A1* | 4/2024 | Shobe | E02F 9/264 |
| 2025/0109574 | A1* | 4/2025 | Thompson | E02F 3/436 |
| 2025/0327278 | A1* | 10/2025 | Fukuda | H04B 17/318 |

* cited by examiner

Fig.3

| |
|---|
| ADV information (Attachment ID,Beacon ID, Vibration information, RSSI, Time information etc.) |
| ADV information (Attachment ID,Beacon ID, Vibration information, RSSI, Time information etc.) |
| ADV information (Attachment ID,Beacon ID, Vibration information, RSSI, Time information etc.) |
| ADV information (Attachment ID,Beacon ID, Vibration information, RSSI, Time information etc.) |
| ⋮ |

Fig.4

| Attachment ID | Display data |
| --- | --- |
| ATT0001 | Name<br>Specifications<br>Icon etc. |
| ATT0002 | Name<br>Specifications<br>Icon etc. |
| ATT0003 | Name<br>Specifications<br>Icon etc. |
| ⋮ | ⋮ |

Fig.5

| Attachment ID | Control data<br>Amount of supply of hydraulic fluid |
|---|---|
| ATT0001 | None |
| ATT0002 | Small |
| ATT0003 | Large |
| ⋮ | ⋮ |

L1

| Name | Attachment ID | Specifications |
|---|---|---|
| Bucket | ATT0001 | Excavation, Large, Total length, Total width, etc. |
| Spreader | ATT0002 | Spreading, Total length, Total width, etc. |
| Skid cutter | ATT0003 | Mowing,Small, Total length, Total width, etc. |
| Pallet fork | ATT00xy | Cargo handling, Total length, Total width, etc. |
| Bucket | ATT00xx | Excavation, Small, Total length, Total width, etc. |
| | ⋮ | ⋮ |

Fig.14

WORKING VEHICLE AND ATTACHMENT USAGE SYSTEM

BACKGROUND OF THE INVENTION

1. Field of the Invention

The present invention relates to techniques to use attachments on working vehicles.

2. Description of the Related Art

For example, the specification of U.S. Patent Application Publication No. 2022/412040 discloses a system to automatically identify the attachment attached to a working vehicle among attachments in the vicinity of the working vehicle. The system is such that a first communication unit (tool module) including a first acceleration sensor is provided on an attachment such as a bucket, a quick changer configured to quickly and simply attach and detach the attachment thereto and therefrom is provided at the distal end of the boom of the working vehicle (excavator), a second communication unit (receiving module) including a second acceleration sensor is provided at the quick changer, and the working vehicle is provided with an identification module and a controller.

The first communication unit transmits, to the second communication unit via a near field communication such as RFID or Bluetooth (registered trademark) Low Energy, a first acceleration signal relating to the instantaneous acceleration of the attachment detected by the first acceleration sensor and an identifying signal of the attachment. The second communication unit transmits, to the identification module, the first acceleration signal and the identifying signal received from the first communication unit and the second acceleration signal relating to the instantaneous acceleration of the quick changer detected by the second acceleration sensor. The identification module identifies the attachment attached to the quick changer based on the comparison (e.g., difference) between the first acceleration signal and the second acceleration signal received from the second communication unit and/or the received signal strength of the first acceleration signal, and transmits the identification information relating to the attachment to the controller. The controller performs an appropriate operation (work action) of the working vehicle based on the received identifying signal.

However, with known systems as described above, the identification of the attachment attached on the working vehicle and the predetermined process may not be performed at the time intended by the user, and responsivity to the user operation may not be good, which may be inconvenient. Also, for example, in cases where the identification module identifies the attachment and performs an appropriate predetermined process each time the attachment is attached or the excavation arm is moved by the user operation for working or each time the first acceleration signal and the second acceleration signal are received by the identification module, the processing load on the identification module needlessly increases, and the predetermined process may not be performed smoothly, which is inefficient.

SUMMARY OF THE INVENTION

Example embodiments of the present invention make it possible for working vehicles to improve the responsivity and the efficiency of a predetermined process corresponding to the attached attachment.

A working vehicle according to an example embodiment of the present invention includes a hitch to attach and detach an attachment thereto and therefrom, a receiver to receive one or more wireless signals which are transmitted periodically from one or more transmitters in or on one or more of the attachments, which include respective one or more pieces of identification information of the one or more attachments, and which are compliant with a near field communication standard, and a controller, wherein the controller is configured or programmed to perform a selecting process and a predetermined process when the attachment is attached to the hitch and when a predetermined operator is operated with the attachment attached to the hitch, the selecting process including selecting, according to a predetermined condition, one of the one or more pieces of identification information that is included in one of the one or more wireless signals received by the receiver, the predetermined process corresponding to the one of the one or more pieces of identification information selected in the selecting process.

An attachment usage system according to an example embodiment of the present invention is a system to perform work using an attachment with a working vehicle, the attachment usage system including the working vehicle and the one or more transmitters.

In an example embodiment of the present invention, the operator may include an attaching switch to be operated to attach the attachment to the hitch. The controller may be configured or programmed to perform the selecting process when the attaching switch is operated to attach the attachment to the hitch and when the attaching switch is operated with the attachment attached to the hitch.

In an example embodiment of the present invention, the controller may be configured or programmed to perform a first selecting process (as the predetermined process) when the attaching switch is operated with no attachments attached to the hitch, the first selecting process including selecting, according to a first condition, one of the one or more pieces of identification information that is included in one of the one or more wireless signals received by the receiver, and perform a second selecting process (as the predetermined process) when the attaching switch is operated with the attachment attached to the hitch, the second selecting process including selecting, according to a second condition differing from the first condition, one of the one or more pieces of identification information that is included in one of the one or more wireless signals received by the receiver.

In an example embodiment of the present invention, the hitch may include a latching mechanism selectively operable in a latching state in which the attachment is secured or an unlatching state in which the attachment is not secured, and an actuator to actuate the latching mechanism selectively to the latching state or the unlatching state. The controller may be configured or programmed to, when the attaching switch is operated while the latching mechanism is in the unlatching state, cause the actuator to actuate the latching mechanism to the latching state and perform the first selecting process, and when the attaching switch is operated while the latching mechanism is in the latching state, perform the second selecting process.

In an example embodiment of the present invention, the controller may be configured or programmed to, when the attaching switch is operated continuously for a first period or more while the latching mechanism is in the unlatching state, cause the actuator to actuate the latching mechanism to the latching state and then start the first selecting process.

In an example embodiment of the present invention, the controller may be configured or programmed to perform the second selecting process when the attaching switch is operated continuously for a second period or more while the latching mechanism is in the latching state, the second period being shorter than the first period.

In an example embodiment of the present invention, the controller may be configured or programmed to cause a memory to store, for a period of time, one or more received signal strengths of the one or more wireless signals received by the receiver and the one or more pieces of identification information included in the one or more wireless signals such that the one or more received signal strengths are in association with the one or more pieces of identification information. The first selecting process may include selecting, according to the first condition, one of the one or more pieces of identification information stored in the memory. The second selecting process may include selecting, according to the second condition, one of the one or more pieces of identification information stored in the memory.

In an example embodiment of the present invention, the first selecting process to be performed by the controller may include selecting one of the one or more pieces of identification information stored in the memory based on at least one of (i) the one or more received signal strengths of the one or more wireless signals corresponding to the one or more pieces of identification information, (ii) one or more points in time at which the one or more wireless signals were received, or (iii) the number of identical ones of the one or more pieces of identification information.

In an example embodiment of the present invention, the second selecting process to be performed by the controller may include extracting, from the memory, one or more specific pieces of identification information included in one or more wireless signals that were received by the receiver during a third period which ended when the attaching switch was operated, and selecting one of the one or more specific pieces of identification information based on at least one of (i) the one or more received signal strengths of the one or more wireless signals corresponding to the extracted one or more specific pieces of identification information, (ii) one or more points in time at which the one or more wireless signals were received, or (iii) the number of identical ones of the extracted one or more specific pieces of identification information.

In an example embodiment of the present invention, the controller may be configured or programmed to, if the controller fails to extract any specific piece of identification information from the memory, select one of one or more newly received pieces of identification information included in one or more wireless signals that were newly received by the receiver during a fourth period which started when the controller failed to extract any specific piece of identification information, based on at least one of (i) one or more received signal strengths of the newly received one or more wireless signals, (ii) one or more points in time at which the one or more wireless signals were newly received, or (iii) the number of identical ones of the one or more newly received pieces of identification information.

In an example embodiment of the present invention, the controller may be configured or programmed to cause a user interface to output, during the fourth period, information indicating that one or more wireless signals are being received.

In an example embodiment of the present invention, the controller may be configured or programmed to, upon detecting that a received signal strength of a wireless signal received by the receiver is higher than a predetermined value and/or that the wireless signal includes vibration information indicating that the attachment is vibrating, cause the memory to store, for the period of time, the received signal strength of the wireless signal and a piece of identification information included in the wireless signal such that the received signal strength is in association with the piece of identification information.

In an example embodiment of the present invention, the working vehicle may further include a traveling device to cause a vehicle body to travel, and a working device to perform work. The hitch may be connected to the working device. The second selecting process to be performed by the controller may include selecting, according to the second condition, one of the one or more pieces of identification information that is included in one of the one or more wireless signals received by the receiver while at least one of the traveling device or the working device is in action.

In an example embodiment of the present invention, the controller may be configured or programmed to, when performing the second selecting process, change the second condition depending on whether any of the one or more pieces of identification information is already selected.

In an example embodiment of the present invention, the controller may be configured or programmed to, when performing the second selecting process, if any of the one or more pieces of identification information is already selected, change the second condition such that the number of pieces of identification information from which a piece of identification information is selected is larger than when no identification information is selected.

In an example embodiment of the present invention, the second condition set by the controller may include at least one condition relating to at least one of (i) one or more received signal strengths of the one or more wireless signals, (ii) one or more points in time at which the one or more wireless signals were received, or (iii) the number of identical ones of the one or more pieces of identification information included in the one or more wireless signals. If any of the one or more pieces of identification information is already selected when the controller performs the second selecting process, the second condition set by the controller may include a larger number of the conditions than when no identification information is selected.

In an example embodiment of the present invention, the predetermined process to be performed by the controller may include performing control corresponding to the one of the one or more pieces of identification information selected in the selecting process and causing a user interface to output information relating to the attachment corresponding to the one of the one or more pieces of identification information.

In an example embodiment of the present invention, the controller may be configured or programmed to, if the currently selected one of the one or more pieces of identification information selected in the selecting process differs from a previously selected one of the one or more pieces of identification information that had been selected until the selecting process was performed, cause the user interface to output information asking whether to use the attachment corresponding to the currently selected one of the one or more pieces of identification information instead of a previous attachment corresponding to the previously selected one of the one or more pieces of identification information, and if an instruction to use the attachment corresponding to the currently selected one of the one or more pieces of identification information is inputted via the user interface, perform the control corresponding to the currently selected one of the one or more pieces of identification information and cause the user interface to output the information relating to the attachment corresponding to the currently selected one of the one or more pieces of identification information.

The above and other elements, features, steps, characteristics and advantages of the present invention will become more apparent from the following detailed description of the example embodiments with reference to the attached drawings.

BRIEF DESCRIPTION OF THE DRAWINGS

A more complete appreciation of example embodiments of the present invention and many of the attendant advantages thereof will be readily obtained as the same becomes better understood by reference to the following detailed description when considered in connection with the accompanying drawings described below.

FIG. 3 is a diagram showing advertising information stored in an internal memory.

FIG. 4 is a diagram showing an example of the relationship between attachment IDs and their corresponding pieces of display data.

FIG. 5 is a diagram showing an example of the relationship between attachment IDs and their corresponding pieces of control data.

FIG. 14 is a screen showing an example of an attachment list.

DETAILED DESCRIPTION OF THE EXAMPLE EMBODIMENTS

Figure 1:
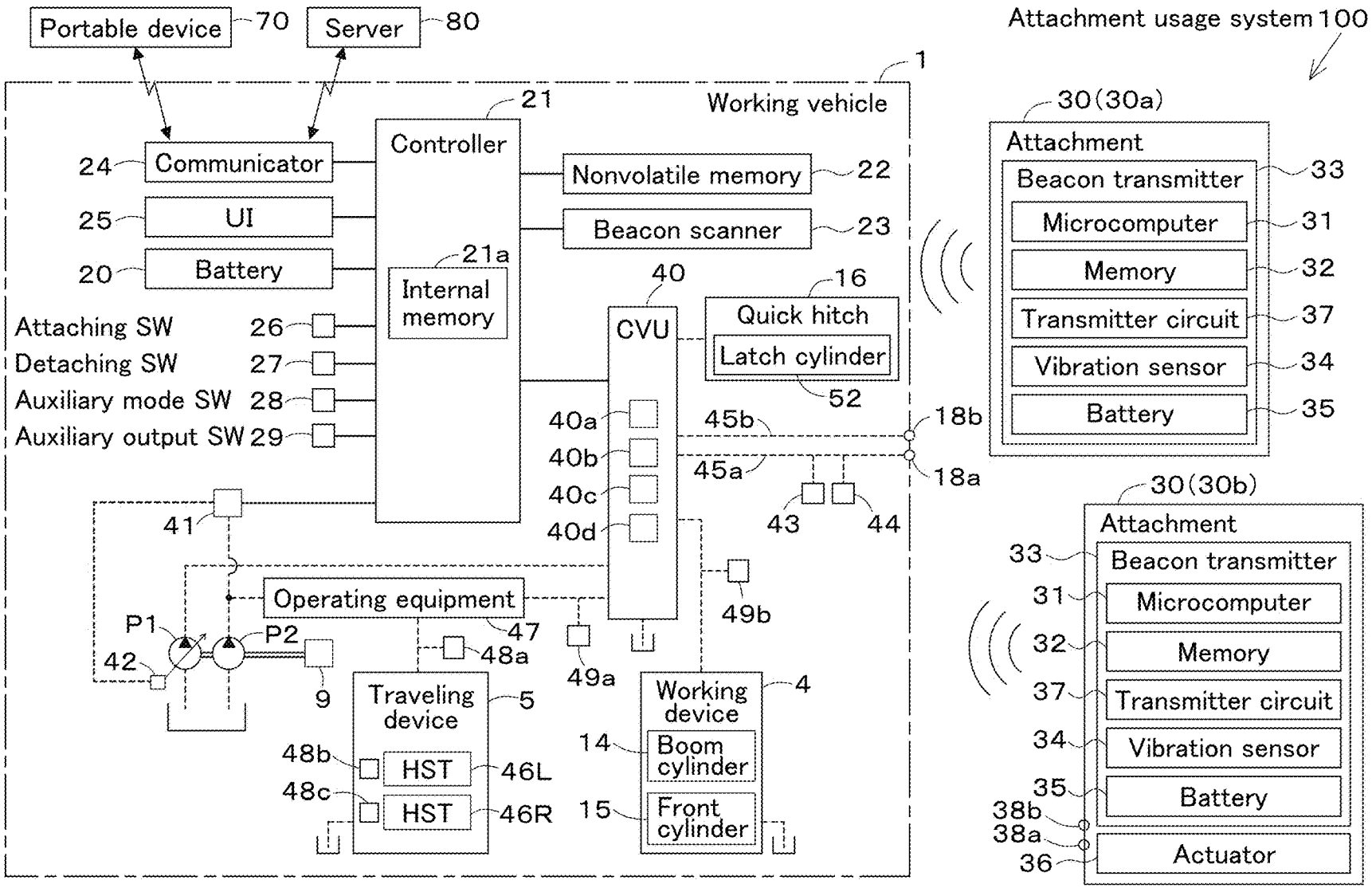
FIG. 1 is a block diagram of an attachment usage system and a working vehicle.

Example embodiments will now be described with reference to the accompanying drawings, wherein like reference numerals designate corresponding or identical elements throughout the various drawings. The drawings are to be viewed in an orientation in which the reference numerals are viewed correctly.

Figure 16:
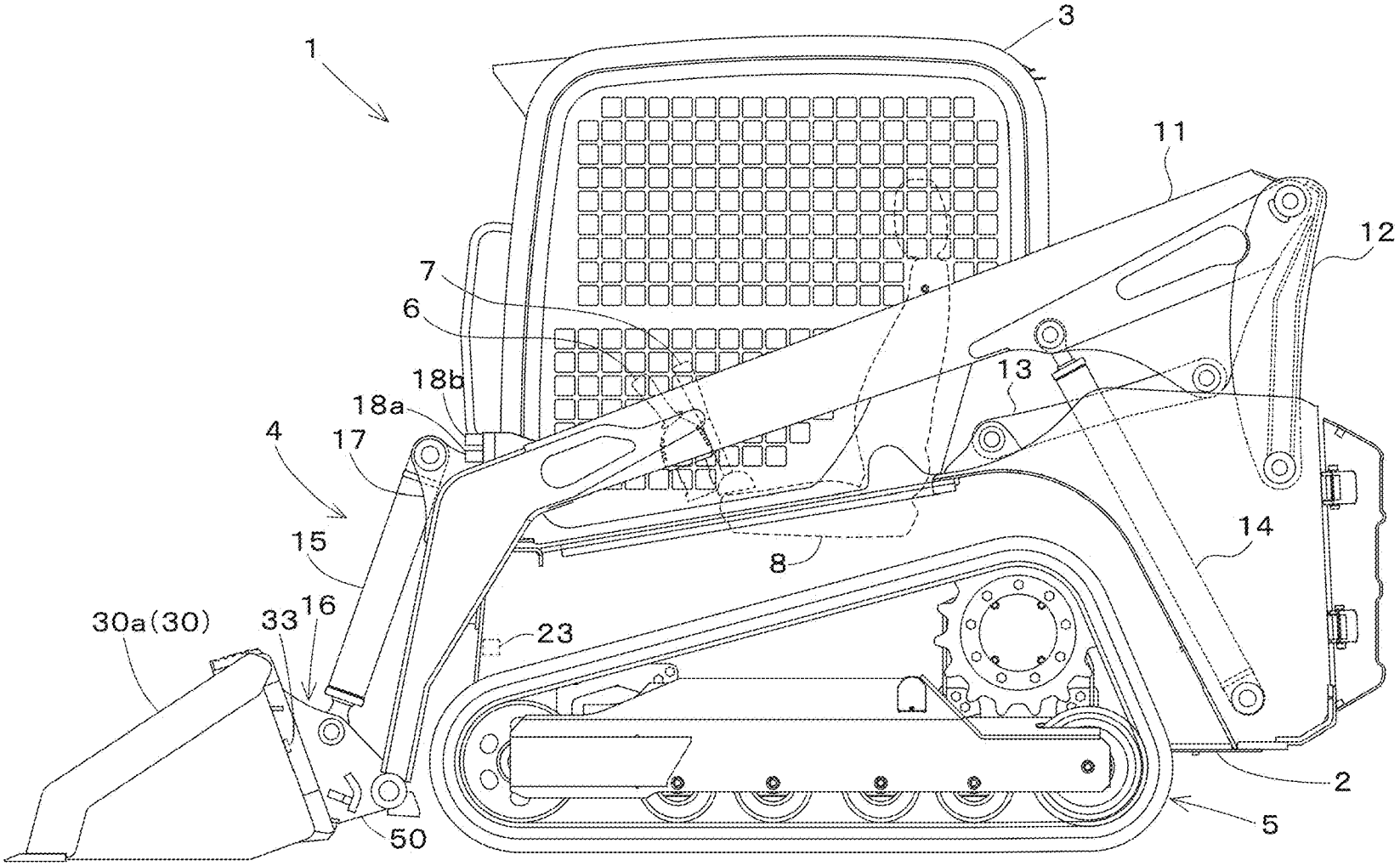
FIG. 16 is a side view of a working vehicle.

FIG. 16 is a side view of a working vehicle 1 according to the present example embodiment. In the present example embodiment, a compact track loader is discussed as an example of the working vehicle 1. Note, however, that the working vehicle according to an example embodiment of the present invention is not limited to a compact track loader, and may be, for example, some other construction machine or agricultural machine such as a skid-steer loader, a backhoe, or a tractor.

The working vehicle 1 includes a vehicle body 2, a cabin 3, a working device 4, and traveling device(s) 5. The cabin 3 is provided on the vehicle body 2. The cabin 3 includes a seat 8, operators (manual operators) to be operated by a user seated on the seat 8, and/or the like. The manual operators include a travel operator 6 to be operated to actuate the traveling devices 5 and a work operator 7 to be operated to actuate the working device 4.

The traveling devices 5 are provided on the left and right sides of the vehicle body 2, support the vehicle body 2, and cause the vehicle body 2 to travel. The traveling devices 5 are crawler traveling devices. The user operates the travel operator 6 to cause both the left and right traveling devices (the traveling device on the left side and the traveling device on the right side) 5 to rotate in a forward direction, both the left and right traveling devices 5 to rotate in a reverse direction, only one of the left and right traveling devices 5 to rotate in the forward direction, or one of the left and right traveling devices 5 to rotate in the forward direction and the other to rotate in the reverse direction to cause the vehicle body 2 (working vehicle 1) to travel forward, rearward, or turn left or right. The travel operator 6 can be operated in operation states corresponding to forward travel, rearward travel, left turn, right turn, and stop of the traveling devices 5.

The working device 4 is attached to the vehicle body 2. The working device 4 includes a bucket 30*a*, boom(s) 11, lift link(s) 12, control link(s) 13, boom cylinder(s) 14, front cylinder(s) 15, and a quick hitch 16. The booms 11, the lift links 12, the control links 13, the boom cylinders 14, and the front cylinders 15 are provided at the left and right of the cabin 3. The left and right booms 11 are connected to each other by a connector 17 at an intermediate portion of their front portion. The left boom 11 has, at the front portion thereof, a hydraulic fluid outlet port (power output port) 18*a* and a hydraulic fluid inlet port 18*b*.

The lift links 12 and the control links 13 support proximal portions (rear portions) of the booms 11 via shafts such that the booms 11 are swingable up and down. The boom cylinders 14 each have one end thereof pivotally connected to a corresponding one of the booms 11 via a shaft and the other end thereof pivotally connected to a lower rear portion of the vehicle body 2 via a shaft. Upon operation of the work operator 7 along a first direction by the user of the working vehicle 1, the boom cylinders 14 extend or retract and the booms 11 ascend or descend (swing upward or downward).

The booms 11 are provided with the quick hitch 16 at the distal ends thereof. The quick hitch 16 is a linkage configured to easily attach and detach any of various attachments 30 such as the bucket 30*a*. An attachment 30 is a working tool to perform work. The user of the working vehicle 1 can easily change attachments 30 using the quick hitch 16. The quick hitch 16 is therefore also called "quick changer". In the example shown in FIG. 16, the bucket 30*a* which is an example of the attachment 30 is attached to a front portion of the quick hitch 16.

The quick hitch 16 has, connected to a rear portion thereof, the distal ends of the booms 11 and ends of the front cylinders 15 via respective shafts such that the booms 11 and the front cylinders 15 are pivotable. The opposite ends of the front cylinders 15 are pivotally connected to the connector 17 via shafts. Upon operation of the work operator 7 along a second direction, the front cylinders 15 extend or retract and the quick hitch 16 swings upward or downward. With this, the bucket 30*a* attached to the quick hitch 16, swinging upward or downward, performs shoveling or dumping. That is, the working device 4 is operable to change at least one of the position or the posture of the attachment 30 attached to the quick hitch 16 to cause the attachment 30 to perform work.

Figure 17:
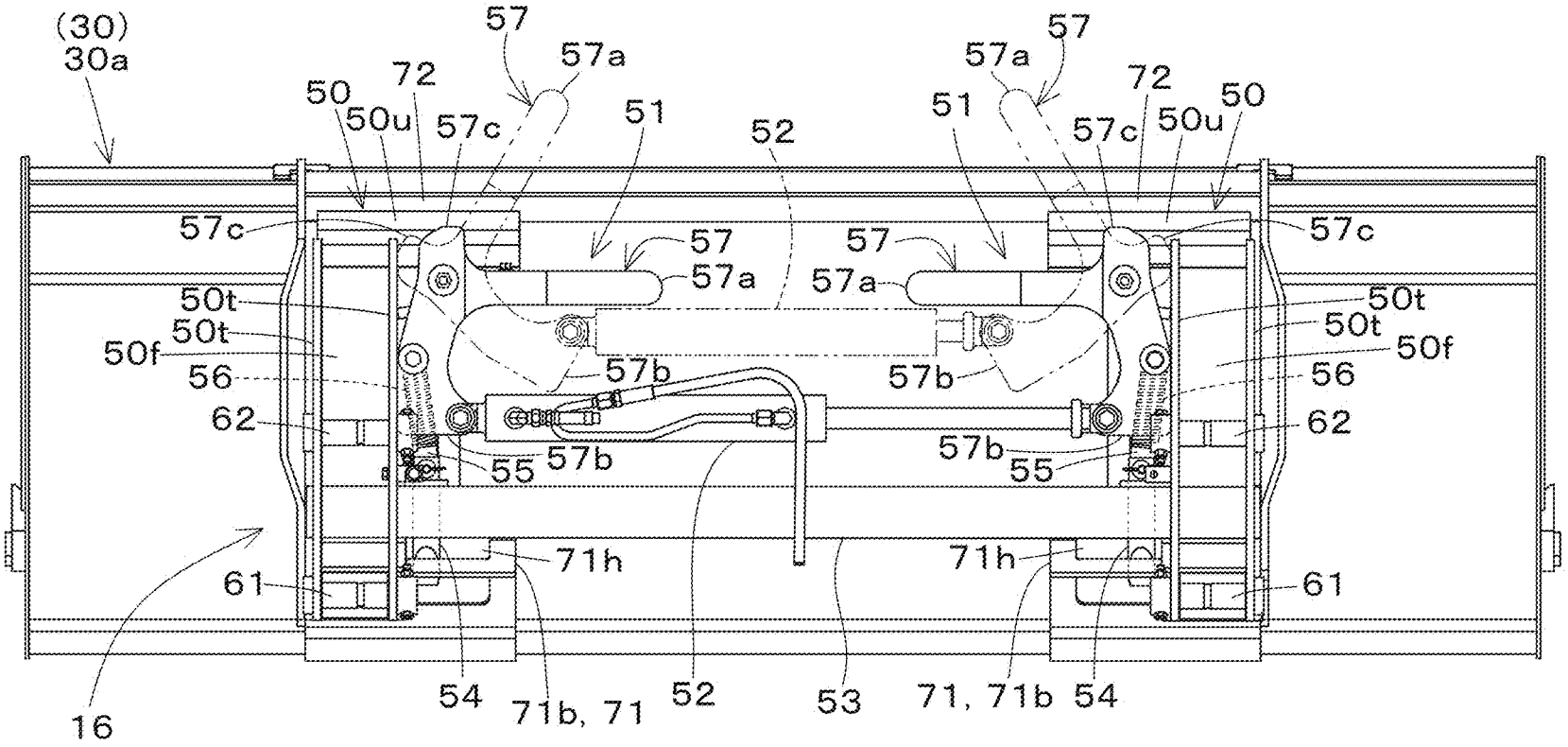
FIG. 17 is an elevational view of a quick hitch.
Figure 18A:
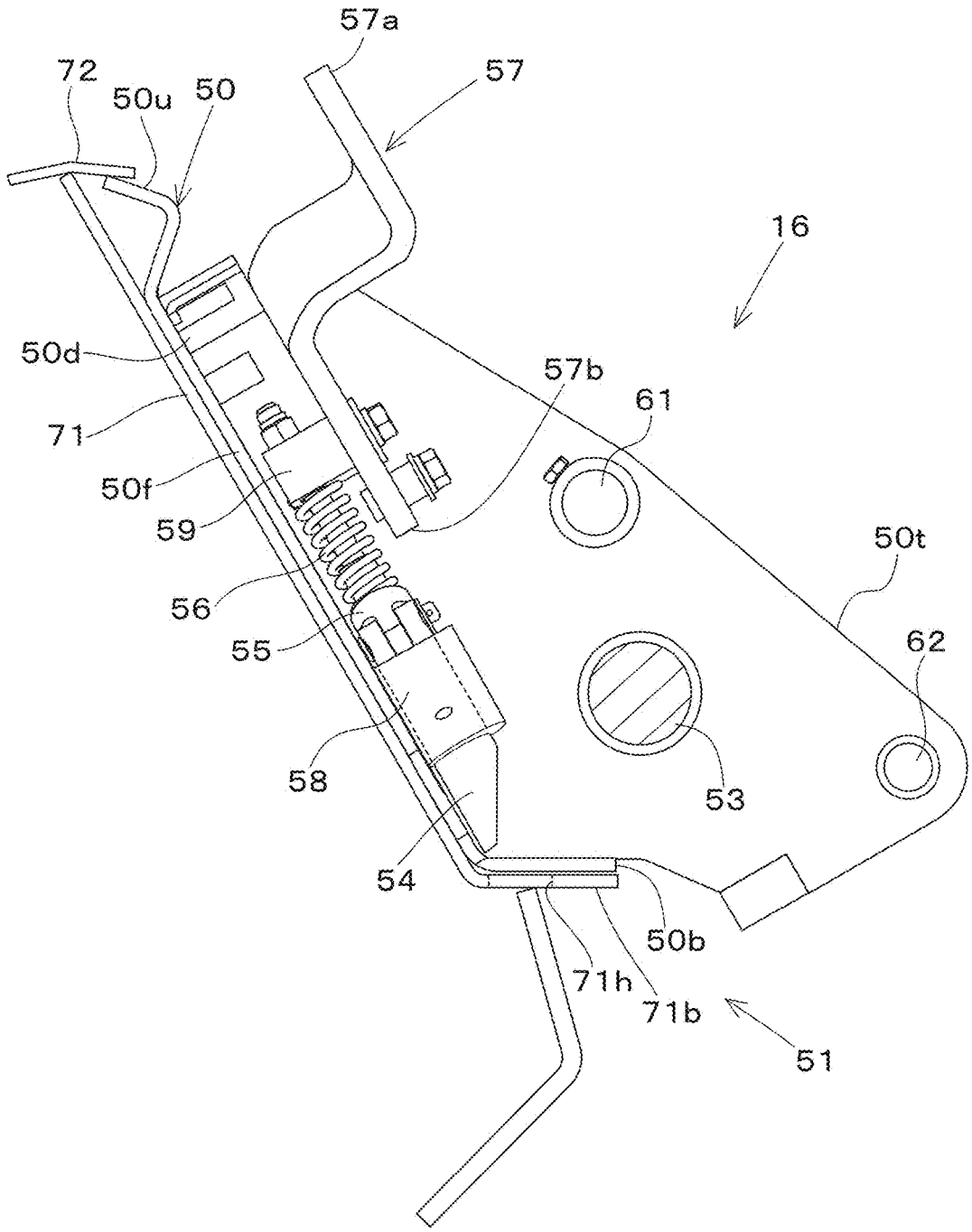
FIG. 18A is a side view of an attachment unlatched by a quick hitch.
Figure 18B:
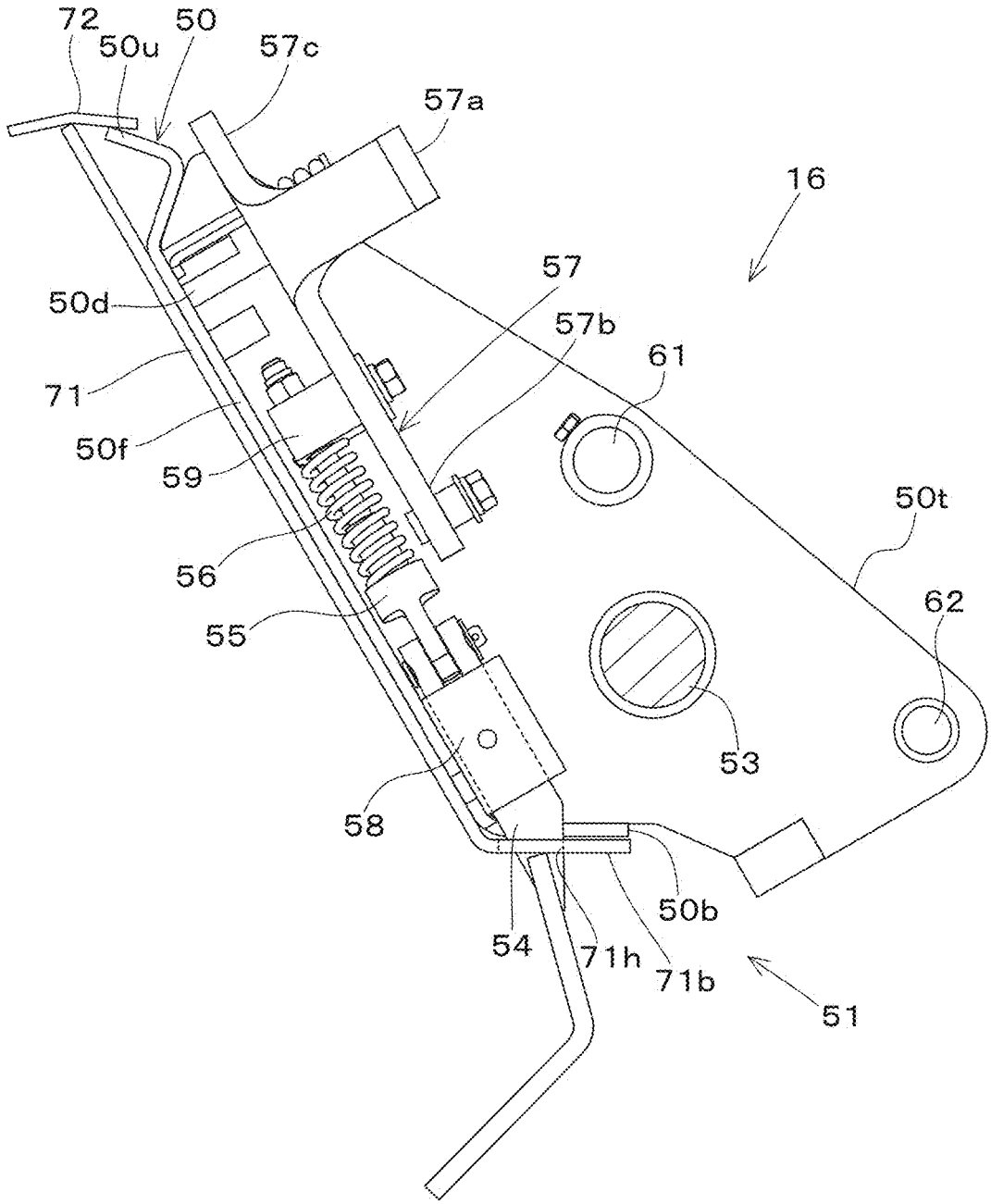
FIG. 18B is a side view of an attachment latched by a quick hitch.

FIG. 17 is an elevational view of the quick hitch 16. Specifically, FIG. 17 illustrates the quick hitch 16 in FIG. 16 as viewed from the vehicle body 2 of the working vehicle 1. FIG. 18A is a side view of an attachment 30 unlatched by the quick hitch 16. FIG. 18B is a side view of the attachment 30 latched by the quick hitch 16.

The quick hitch 16 includes a pair of left and right brackets 50, a pair of left and right latching mechanisms 51, a latch cylinder 52, and the like. The brackets 50 hold the attachment 30. The latching mechanisms 51 are selectively operable in a latching state in which the attachment 30 is secured to the brackets 50 (quick hitch 16) or an unlatching state in which the attachment 30 is not secured (is released) and is allowed to be detached from the brackets 50. The latch cylinder 52 is a latch actuator to place the latching mechanisms 51 selectively in the latching state or the unlatching state.

As illustrated in FIG. 18A, each of the brackets 50 includes a front plate 50*f* and a pair of connector plates 50*t* projecting rearward from the front plate 50*f*. The connector plates 50*t* have pivotally connected thereto the distal ends of the left and right booms 11 (FIG. 16) via shafts 61, and have pivotally connected thereto ends of the left and right front cylinders 15 (FIG. 16) via shafts 62. The connector plates 50*t* are connected to a beam 53, so that the pair of brackets 50 are combined.

The front plate 50*f* of each of the brackets 50 includes an upper portion 50*u* bent in the form of the letter V as illustrated in FIG. 18A. The front plate 50*f* includes a lower portion 50*b* bent such that the lower portion 50*b* projects diagonally rearward. A top plate 72 bent downward is provided above a base plate 71 of the attachment 30. The base plate 71 includes a lower portion 71*b* bent such that the lower portion 71*b* projects diagonally rearward. The lower portion 71*b* of the base plate 71 has a through-hole 71*h*.

The upper portions 50*u* of the front plates 50*f* of the brackets 50 are inserted into the gap between the base plate 71 and the top plate 72 of the attachment 30 and engage with the back surface of the top plate 72, the front surfaces of the front plates 50*f* engage with the base plate 71, and the lower portions 50*b* of the front plates 50*f* engage with the lower portion 71*b* of the base plate 71. With this, the attachment 30 is held by the brackets 50.

The latching mechanisms 51 are located inward of the connector plates 50*t* of the brackets 50 in FIG. 17. Each of the latching mechanisms 51 includes, as illustrated in FIG. 18A, a latch pin 54, a link 55, a coil spring 56, a latch lever 57, and the like. The latch pin 54 is held by a housing 58 fixed to a corresponding bracket 50 such that the latch pin 54 is movable up and down. The latch pin 54 includes a lower portion projecting downward from the housing 58, and the lower portion has an inclined surface sloping diagonally forward and downward. The latch pin 54 includes an upper portion rotatably connected to a lower end portion of the link 55 via pin(s). The link 55 is inserted in the coil spring 56. The link 55 includes an upper end portion projecting from the coil spring 56, and the upper end portion is held by a holder 59.

Each latch lever 57 is substantially in the form of the letter L as illustrated in FIG. 17. The latch lever 57 includes a bent intermediate portion which is rotatably connected to a mount 50*d* on a corresponding bracket 50 via pin(s) as illustrated in FIG. 18A. The latch lever 57 includes a first projecting portion 57*a* which projects inward from corresponding connector plates 50*t* as illustrated in FIG. 17. The latch lever 57 includes a second projecting portion 57*b* projecting downward. The second projecting portion 57*b* has, connected to a back surface of a central portion thereof, the holder 59 via pin(s) as illustrated in FIG. 18A. The latch lever 57 includes a third projecting portion 57*c* which projects upward as illustrated in FIG. 17.

The latch cylinder 52 is a hydraulic cylinder which is positioned laterally and located above the beam 53. The latch cylinder 52 has a first end (distal end of the rod) pivotally connected to the distal end portion of the second projecting portion 57*b* of one of the latch levers 57 (right latch lever 57 in FIG. 17) via pin(s). The latch cylinder 52 has a second end (bottom of the cylinder case) pivotally connected to the distal end portion of the second projecting portion 57*b* of the other of the latch levers 57 (the left latch lever 57 in FIG. 17) via pin(s).

The retraction of the latch cylinder 52, as indicated by dot-dot-dash lines in FIG. 17, causes the second projecting portions 57*b* of the left and right latch levers 57 to approach each other, causing the latch levers 57 to pivot upward. Then, as illustrated in FIG. 18A, the links 55 and the latch pins 54 move upward and the latch pins 54 detach from the through-holes 71*h* in the base plate 71 of the attachment 30.

With this, the latching mechanisms 51 are placed in their unlatching state (also referred to as "unlock state") in which the latching mechanisms 51 do not hold the attachment 30, allowing the attachment 30 to be detached from the quick hitch 16. The third projecting portions 57*c* of the latch levers 57 contact corresponding connector plates 50*t* of the brackets 50, so that the degree of retraction of the latch cylinder 52, the angle of upward rotation of the latch levers 57, and the degree of upward movement of the latch pins 54 are restricted.

Upon the extension of the latch cylinder 52 as indicated by solid lines in FIG. 17 from the state as illustrated in FIG. 18A, the second projecting portions 57*b* of the left and right latch levers 57 are pushed to cause the latch levers 57 to pivot downward. Upon such pivoting, the holders 59 cause the links 55 and the latch pins 54 to move downward and compress the coil springs 56. Then, as illustrated in FIG. 18B, the latch pins 54 are inserted in the through-holes 71*h* in the base plate 71 of the attachment 30, so that the inclined surfaces of the latch pins 54 contact the side walls of the through-holes 71*h*.

With this, the latching mechanisms 51 are placed in their latching state (also referred to as "lock state") in which the latching mechanisms 51 hold the attachment 30, and the attachment 30 is attached to the quick hitch 16. The second projecting portions 57*b* of the latch levers 57 contact corresponding connector plates 50*t* of the brackets 50, so that the degree of extension of the latch cylinder 52, the angle of downward rotation of the latch levers 57, and the degree of downward movement of the latch pins 54 are restricted. It is noted here that the spring back force of the coil springs 56 holds the latch levers 57 in position. Since the first projecting portions 57*a* of the latch levers 57 are positioned horizontally, the user seated on the seat 8 of the working vehicle 1 confirms that the attachment 30 is attached to the quick hitch 16 (working vehicle 1) by looking at the horizontally positioned first projecting portions 57*a*.

Starting from the state as illustrated in FIG. 16 in which the bucket 30*a* is attached to the quick hitch 16, the bucket 30*a* is detached and another attachment 30 is attached to the quick hitch 16. This makes it possible to perform work other than excavation (or some other excavation work) using the other attachment 30.

Examples of attachments 30 other than the bucket 30*a* include pallet forks, skid cutters, crushers, breakers, angle brooms, earth augers, grapple, sweepers, mowers, snow blowers, and spreaders. Attachments 30 of each type may have different specifications such as sizes and/or shapes. In the present example embodiment, a hydraulic-driven attachment 30 is used, but an electric attachment may be used instead.

FIG. 1 is a block diagram of an attachment usage system 100 and the working vehicle 1 according to the present example embodiment. The attachment usage system 100 includes the working vehicle(s) 1 and attachment(s) 30. The example in FIG. 1 includes one working vehicle 1 and two attachments 30, but the number of working vehicles 1 and the number of attachments 30 included in the attachment usage system 100 may be selected appropriately.

The working vehicle 1 includes a controller 21, one or more nonvolatile memories 22, a beacon scanner 23, a communicator 24, a user interface (indicated as "UI" in FIG. 1) 25, a battery 20, switches (each indicated as "SW" in FIGS. 1) 26 to 29, and/or the like.

The controller 21 includes, for example, an information processor circuit including processor(s) and memory (memories). Specifically, the controller 21 includes a computer. The controller 21 is configured or programmed to control the working vehicle 1, and perform various controls relating to the working vehicle 1. The controller 21 is communicably connected to devices in or on the working vehicle 1 via an in-vehicle network such as CAN, ISOBUS, LIN, and/or FlexRay.

Examples of the processor(s) of the controller 21 include central processing unit (CPU), graphics processing unit (GPU), digital signal processor (DSP), field programmable gate array (FPGA), and application specific integrated circuit (ASIC).

Note that the controller 21 may include a plurality of physically separated processors which operate together to perform various processes, and the configuration thereof is not limited to those mentioned above. In such a case, the plurality of processors are provided in one or more computers physically separated from the working vehicle 1, and are communicably connected together via an in-vehicle network and/or an external network such as LAN, WAN, and/or the Internet.

The controller 21 includes an internal memory 21*a* (first memory) which is a volatile memory or a nonvolatile memory. The controller 21 may, for example, use a predetermined storage area of the internal memory 21*a* which is a volatile memory as a buffer for temporary storage of information and data.

The one or more nonvolatile memories 22 (second memory, third memory) are one or more storing devices provided externally to the controller 21. The internal memory 21*a* and the nonvolatile memory 22 store software program(s) and control data for the controller 21 to control operation of the elements. The nonvolatile memory 22 stores pieces of data for control and data for display corresponding to various attachments 30.

The software program(s) may be stored in recording medium (media) (nonvolatile memory such as HDD, SSD, CD-ROM, DVD-ROM) communicably connected to the controller 21 and/or in an external server 80 connected to the controller 21 via an external network, and may be installed from the recording medium (media) and/or the external server 80 onto the internal memory 21*a* and/or the nonvolatile memory 22. The same applies to the foregoing data for control and data for display.

The beacon scanner 23 is a receiver to receive wireless signals (beacon signals) compliant with Bluetooth (registered trademark) Low Energy which is a near field communication standard. The beacon scanner 23 includes a measuring circuit to measure the received signal strength indicator (RSSI, received signal strength) of the received wireless signals.

The communicator 24 includes an electric circuit (communication interface) for communication via at least one of wireless LAN, near field communication, the Internet, or the like. The communicator 24 communicates with the portable device 70 and the server 80 in a wireless manner. The portable device 70 is a smartphone, a tablet computer, and/or the like. The user interface 25 includes an input and an output of the working vehicle 1, and includes, for example, a touchscreen (touch panel) including a display and/or the like. For another example, the user interface 25 may include an input and an output (display) provided independently of each other.

The battery 20 supplies electricity to electric equipment in and/or on the working vehicle 1. The attaching switch 26, the detaching switch 27, the auxiliary mode switch 28, and the auxiliary output switch 29 are respective operation switches to be operated by the user of the working vehicle 1. The attaching switch 26 and the detaching switch 27 are momentary operation switches. The user interface 25 and the switches 26 to 29 are provided operably in the vicinity of the seat 8 in the cabin 3.

The attaching switch 26 is operated to attach (secure, fasten) the attachment 30 to the quick hitch 16. The detaching switch 27 is operated to allow the attachment 30 to be detached from the quick hitch 16 (to unfasten the attachment 30 from the quick hitch 16). The auxiliary mode switch 28 is operated to start an auxiliary mode in which predetermined attachment(s) 30 are usable. The auxiliary output switch 29 is operated to supply (output) hydraulic fluid as power for an actuator 36 of the attachment 30 via the hydraulic fluid outlet port 18*a* to the attachment 30.

The working vehicle 1 includes, as hydraulic-related features, a main pump P1, a pilot pump P2, a control valve unit (indicated as "CVU" in FIG. 1) 40, a proportional valve 41, a regulator 42, sensors 43 and 44, hydraulic actuators 14, 15, 46L, 46R, and 52, fluid passage(s), a tank, and/or the like. The main pump P1 and the pilot pump P2 are driven by power from a prime mover 9 to deliver hydraulic fluid sucked from the tank to fluid passage(s). The prime mover 9 includes, for example, an engine. For another example, the prime mover 9 may include an electric motor.

The main pump P1 is a variable displacement hydraulic pump. The regulator 42 changes the angle of the swash plate of the main pump P1. The controller 21 controls the opening of the proportional valve 41 to apply pilot pressure, which is the hydraulic pressure of hydraulic fluid delivered by the pilot pump P2, to the regulator 42. The controller 21 then actuates the regulator 42 to change the angle of the swash plate of the main pump P1 to change the amount of hydraulic fluid delivered by the main pump P1. Operating equipment 47 includes the travel operator 6 and work operator 7, operating valves corresponding to the travel operator 6 and the work operator 7, switching valve(s), and the like.

The control valve unit 40 allows hydraulic fluid supplied from the main pump P1 through fluid passage(s) to flow to the boom cylinders 14 and the front cylinders 15 of the working device 4, the latch cylinder 52 of the quick hitch 16, and the hydraulic fluid outlet port 18*a*. The control valve unit 40 also allows hydraulic fluid that flows from the boom cylinders 14, the front cylinders 15, the latch cylinder 52, and the hydraulic fluid inlet port 18*b* (return fluid) to be discharged. The control valve unit 40 controls the direction and amount of supply of hydraulic fluid to the boom cylinders 14, the front cylinders 15, and the latch cylinder 52. The control valve unit 40 also controls the amount of supply of hydraulic fluid to the hydraulic fluid outlet port 18*a*.

Specifically, the control valve unit 40 includes control valves 40*a*, 40*b*, 40*c*, and 40*d* corresponding to the boom cylinders 14, the front cylinders 15, the latch cylinder 52, and the ports 18*a* and 18*b*. Each of the control valves 40*a*, 40*b*, 40*c*, and 40*d* is switchable between a neutral position, a first position, and a second position. At least the control valves 40*c* and 40*d*, corresponding to the latch cylinder 52 and the ports 18*a*, 18*b*, of the control valves 40*a*, 40*b*, 40*c*, and 40*d* are electrically actuated solenoid valves. The control valves 40*a*, 40*b*, 40*c*, and 40*d* are normally held in the neutral position by the elastic force of a spring.

The operating equipment 47 includes the work operator 7 and work operating valves corresponding to the work operator 7. The work operating valve(s) is/are actuated according to the manner in which the work operator 7 is operated, thus allowing the pilot pressure of pilot fluid from the pilot pump P2 to act on pressure receiver(s) of the corresponding control valve(s) 40*a* and/or 40*b* via the actuated work operating valve(s). For example, the work operator 7 may be supported on the work operating valves and the work operating valves may be physically actuated by operation of the work operator 7. Additionally or alternatively, a detection sensor to detect the amount (degree) and direction of operation of the work operator 7 may be provided and the controller 21 may electrically actuate the work operating valve(s) based on the detection result from the detection sensor.

With this, the control valve(s) 40*a* and/or 40*b* is/are switched from the neutral position to the first position or the second position, so that hydraulic fluid from the main pump P1 is supplied through the control valve(s) 40*a* and/or 40*b* to the boom cylinders 14 and/or the front cylinders 15 to cause the boom cylinders 14 and/or the front cylinders 15 to extend or retract. It follows that the booms 11 and/or the attachment 30 such as the bucket 30*a* attached to the quick hitch 16 swing.

The pilot pressure (work operating pressure) acting on the pressure receivers of the control valves 40*a* and 40*b* from the work operating valves of the operating equipment 47 is detected by pressure sensors 49*a*. Although only a single pressure sensor 49*a* is illustrated in FIG. 1, actually pressure sensors 49*a* (four pressure sensors 49*a*) are connected to respective fluid passages (four fluid passages) to supply pilot fluid to respective pressure receivers of the control valves 40*a* and 40*b* (two pressure receivers of the control valve 40*a* and two pressure receivers of the control valve 40*b*). The controller 21 determines the operation state of the work operating valves and the work operator 7 of the operating equipment 47 based on the pilot pressure detected by the pressure sensors 49*a*.

For another example, detection sensor(s) such as potentiometer(s) to detect the angle of rotation of the work operator 7, etc., may be provided instead of the pressure sensors 49*a*. The controller 21 may determine the operation state of the work operating valves and the work operator 7 of the operating equipment 47 based on output signal(s) from the detection sensor(s). Such detection sensors and pressure sensors 49*a* are examples of work operation sensors to detect the operation state of the work operator 7, and the work operation sensors are not limited to those described above. In a case that the work operator 7 is an electric work operator to output an electric signal (operation signal) corresponding to the operation state such as a joystick, the controller 21 may determine the operation state of the work operator based on the electric signal.

The pressure of hydraulic fluid supplied from the control valves 40*a* and 40*b* to the boom cylinders 14 and the front cylinders 15, i.e., the supply pressure of hydraulic fluid to the boom cylinders 14 and the supply pressure of hydraulic fluid to the front cylinders 15, are detected by pressure sensors 49*b*. Although only a single pressure sensor 49*b* is illustrated in FIG. 1, actually pressure sensors 49*b* (two pressure sensors 49*b*) are connected to a fluid passage to supply hydraulic fluid from the control valve 40*a* to the boom cylinders 14 and a fluid passage to supply hydraulic fluid from the control valve 40*b* to the front cylinders 15.

The controller 21 determines the action status (acting state or stopped state) of the working device 4 (including the boom cylinders 14, booms 11, front cylinders 15, quick hitch 16, and the like) based on the supply pressure of hydraulic fluid to the boom cylinders 14 and the supply pressure of hydraulic fluid to the front cylinders 15 detected by the pressure sensors 49*b*. The controller 21 regards the supply pressure of hydraulic fluid to the boom cylinders 14 and the supply pressure of hydraulic fluid to the front cylinders 15 as loads on the boom cylinders 14 and the front cylinders 15, and regards the greater of the supply pressures as the load on the working device 4.

For another example, detection sensor(s) to detect the angle of rotation achieved by the boom cylinders 14 and the front cylinders 15, and vibration, acceleration, and/or the like of the boom cylinders 14 and the front cylinders 15 may be provided instead of the pressure sensors 49*b*. Such detection sensors and pressure sensors 49*b* are examples of work detection sensors to detect the action status of the boom cylinders 14 and the front cylinders 15, and the work detection sensors are not limited to those described above. In a case that the control valves 40*a* and 40*b* are solenoid valves, the controller 21 may determine the action status of the working device 4 based on the switching positions of the control valves 40*a* and 40*b* controlled by the controller 21.

The controller 21 controls the actuation of the latch cylinder 52 in response to the operation of the attaching switch 26 or the detaching switch 27 of the switches 26 to 29 connected to the controller 21. For example, while the attaching switch 26 is being operated, the controller 21 places the control valve 40*c* in the first position to allow hydraulic fluid from the main pump P1 to be supplied to the latch cylinder 52 in the first direction to cause the latch cylinder 52 to extend. Accordingly, the operation of the attaching switch 26 that lasts for a predetermined period of time (first period) Ta1 or more while the latching mechanisms 51 are in the unlatching state causes the latch cylinder 52 to extend to the predetermined degree or more, bringing the latching mechanisms 51 into the latching state.

Even if the attaching switch 26 is operated, provided that the operation only lasts for a period less than the predetermined period of time Ta1, the latch cylinder 52 does not extend to the predetermined degree or more and therefore the latching mechanisms 51 are not brought into the latching state. Therefore, the latching mechanisms 51 are moved back by the spring back force of the coil springs 56 to the original unlatching state.

On the contrary, while the detaching switch 27 is being operated, the controller 21 places the control valve 40*c* in the second position to allow hydraulic fluid from the main pump P1 to be supplied to the latch cylinder 52 in a second direction opposite to the first direction to cause the latch cylinder 52 to retract. Accordingly, the operation of the detaching switch 27 that lasts for a predetermined period of time Td or more while the latching mechanisms 51 are in the latching state causes the latch cylinder 52 to retract to a predetermined degree or more, bringing the latching mechanisms 51 into the unlatching state.

Even if the detaching switch 27 is operated, provided that the operation only lasts for a period less than the predetermined period of time Td, the latch cylinder 52 does not retract to the predetermined degree or more and therefore the latching mechanisms 51 are not brought into the unlatching state. Therefore, the latching mechanisms 51 are moved back by the spring back force of the coil springs 56 to the original latching state. The controller 21 determines whether the latching mechanisms 51 are in the latching state or the unlatching state based on, for example, the position of the control valve 40*c*.

The predetermined periods of time Ta1, Td for the switches 26 and 27 are each, for example, about 2 to 3 seconds. The predetermined periods of time for the switches 26 and 27 may be the same period or different periods. The specific values of the predetermined periods of time Ta1, Td are examples, and not limited to the values above. The specific values of another predetermined period of time and a period of time (described later) are also examples and not limited thereto.

When the auxiliary mode switch 28 is operated and the auxiliary mode is selected, a specific attachment 30 is attached to the quick hitch 16. The hydraulic fluid outlet port 18*a* and a hydraulic fluid inlet port 38*b* of the specific attachment 30*b* are connected together by a hose, and the hydraulic fluid inlet port 18*b* and a hydraulic fluid outlet port 38*a* of the specific attachment 30*b* are connected together by a hose.

Upon operation of the auxiliary output switch 29 under such circumstances, the controller 21 switches the control valve 40*d* from the neutral position to the first position or the second position. With this, hydraulic fluid from the main pump P1 is supplied (transmitted) through a fluid passage 45*a* to the hydraulic fluid outlet port 18*a*, and hydraulic fluid flowing into a fluid passage 45*b* from the hydraulic fluid inlet port 18*b* is drained through the control valve unit 40.

The hydraulic fluid discharged through the hydraulic fluid outlet port 18*a* is introduced into the specific attachment 30*b* through the hydraulic fluid inlet port 38*b* via a hose or the like. Furthermore, hydraulic fluid (return fluid) discharged through the hydraulic fluid outlet port 38*a* of the specific attachment 30*b* is introduced through the hydraulic fluid inlet port 18*b* via a hose or the like and is drained from the control valve unit 40. Since hydraulic fluid is introduced and discharged to and from the specific attachment 30*b* as such, hydraulic actuators 36 such as a hydraulic motor and/or hydraulic cylinder(s) of the attachment 30*b* are actuated, making it possible to perform work using the attachment 30*b*.

When allowing hydraulic fluid to be introduced and discharged to and from the specific attachment 30*b*, the controller 21 changes the opening of the control valve 40*d* depending on what specific attachment 30*b* is attached to the quick hitch 16, to adjust the flow rate or hydraulic pressure of hydraulic fluid supplied to the hydraulic fluid outlet port 18*a*. For example, the controller 21 may cause the flow rate sensor 43 to detect the flow rate of hydraulic fluid flowing through the fluid passage 45*a* and control the opening of the control valve 40*d*. Additionally or alternatively, the controller 21 may cause the pressure sensor 44 to detect the hydraulic pressure of hydraulic pressure flowing through the fluid passage 45*a* and control the opening of the control valve 40*d*.

The pair of left and right traveling devices 5 include a pair of left and right hydro-static transmissions (HSTs) 46L and 46R corresponding to the pair of left and right traveling devices 5. Each of the HSTs 46L and 46R includes hydraulic pump(s) and a travel motor (hydraulic motor).

The operating equipment 47 includes the travel operator 6 and travel operating valves corresponding to the travel operator 6. The travel operating valve(s) is/are actuated according to the manner in which the travel operator 6 is operated, thus allowing the pilot pressure of pilot fluid from the pilot pump P2 to act on pressure receiver(s) of the hydraulic pump(s) of the corresponding HST(s) 46L and/or 46R via the actuated travel operating valve(s) and changing the angle of inclination of swash plate(s) of the hydraulic pump(s). For example, the travel operator 6 may be supported on the travel operating valves and the travel operating valves may be physically actuated by operation of the travel operator 6. Additionally or alternatively, a detection sensor to detect the amount (degree) and direction of operation of the travel operator 6 may be provided and the controller 21 may electrically actuate the travel operating valve(s) based on the detection result from the detection sensor.

This controls the supply, the stopping of supply, and the direction of supply of hydraulic fluid from the hydraulic pump(s) of the HSTs 46L and/or 46R to the travel motor(s), the travel motor(s) rotate(s) in the forward direction, rotate in the reverse direction, or stop, the left and/or right traveling device(s) 5 also rotate(s) in the forward direction, rotate in the reverse direction, or stop, and the working vehicle 1 travels forward, rearward, turn left or right, or stops.

The operating equipment 47 includes a travel switching valve for speed change. The position of the travel switching valve is switched in response to a control signal from the controller 21, thus changing the angle of inclination of the swash plate(s) of the travel motor(s) of the HSTs 46L and/or 46R. With this, the rotation speed of the travel motor(s) increases or decreases, so that the travel speed of the traveling devices 5 and the working vehicle 1 is changed.

The pilot pressure (travel operating pressure) acting on the pressure receivers of the hydraulic pumps of the HSTs 46L and 46R from the travel operating valves of the operating equipment 47 is detected by pressure sensors 48*a*. Although only a single pressure sensor 48*a* is illustrated in FIG. 1, actually pressure sensors 48*a* (four pressure sensors 48*a*) are connected to respective fluid passages (four fluid passages) to supply pilot fluid to respective pressure receivers of the hydraulic pumps of the HSTs 46L and 46R (two pressure receivers of the hydraulic pump of the HST 46L and two pressure receivers of the hydraulic pump of the HST 46R). The controller 21 determines the operation state of the travel operating valves and the travel operator 6 of the operating equipment 47 based on the pilot pressure detected by the pressure sensors 48*a*.

For another example, detection sensor(s) such as potentiometer(s) to detect the angle of rotation of the travel operator 6, etc. may be provided instead of the pressure sensors 48*a*. The controller 21 may determine the operation state of the travel operating valves and the travel operator 6 of the operating equipment 47 based on output signal(s) from the detection sensor(s). Such detection sensors and pressure sensors 48*a* are examples of travel operation sensors to detect the operation state of the travel operator 6, and the travel operation sensors are not limited to those described above. In a case that the travel operator 6 is an electric travel operator, such as a joystick, to output an electric signal (operation signal) corresponding to the operation state, the controller 21 may determine the operation state of the travel operator based on the electric signal.

The pressure of hydraulic fluid supplied from the hydraulic pumps of the HSTs 46L and 46R to the travel motors, i.e., the travel pressure for the left traveling device 5 and the travel pressure for the right traveling device 5, are detected by pressure sensors 48*b*. Although only a single pressure sensor 48*b* is illustrated in FIG. 1, actually pressure sensors 48*b* (four pressure sensors 48*b*) are connected to fluid passages (supply fluid passage and return fluid passage) to allow hydraulic fluid to circulate between the hydraulic pump of the HST 46L and the travel motor corresponding to the left traveling device 5 and fluid passages (supply fluid passage and return fluid passage) to allow hydraulic fluid to circulate between the hydraulic pump of the HST 46R and the travel motor corresponding to the right traveling device 5.

The controller 21 determines the action status (traveling forward/rearward, turning, and stopping) of the traveling devices 5 (left traveling device 5 and right traveling device 5) based on the travel pressure detected by the pressure sensors 48*b*. The controller 21 may cause rotation speed sensors 48*c* to detect the rotation speed of the travel motors of the HSTs 46L and 46R instead of the pressure sensors 48*b*, and determine the action status of the traveling devices 5 based on the detection result. The rotation speed sensors 48*c* and the pressure sensors 48*b* are examples of travel detection sensors to detect the action status of the traveling devices 5, and the travel detection sensors are not limited to those described above.

The attachment 30 attachable to the working vehicle 1 is provided with a beacon transmitter 33. The beacon transmitter 33 is a transmitter to periodically transmit an advertisement signal (also called "advertisement packet" or "beacon signal") which is a wireless signal compliant with Bluetooth (registered trademark) Low Energy. The beacon transmitter 33 looks like a small tag, and is therefore sometimes called a "BLE tag". The beacon transmitter 33 includes a microcomputer 31, a non-volatile memory 32, a transmitter circuit 37, a battery 35, a vibration sensor 34, and/or the like. The elements of the beacon transmitter 33 are driven by electricity from the battery 35. The beacon transmitter 33 transmits the advertisement signal at interval (s) of, for example, about 1 second to about 3 seconds, but the intervals are not limited to about 1 second to about 3 seconds and may be selected as appropriate.

Figure 2:
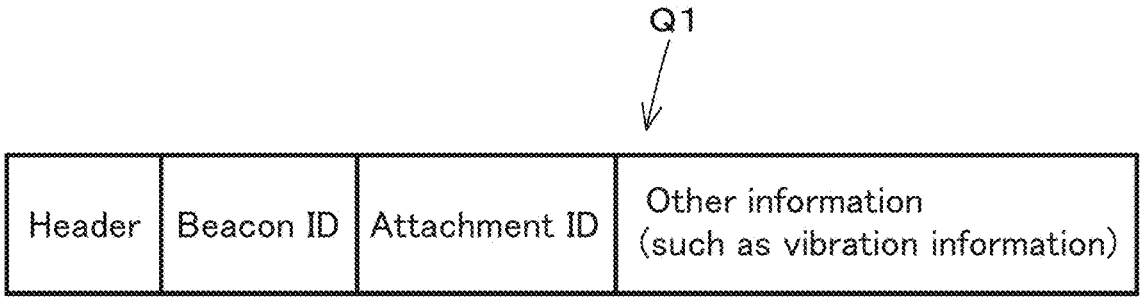
FIG. 2 is a diagram showing an example of information included in an advertisement signal.

FIG. 2 shows an example of information contained in an advertisement signal (hereinafter referred to as "ADV signal") Q1 transmitted from the beacon transmitter 33. The ADV signal Q1 includes a header, a beacon ID, an attachment ID, and other information. The beacon ID is identification information relating to the beacon transmitter 33 which is the sender of the ADV signal Q1. The attachment ID is identification information relating to the attachment 30 in or on which the beacon transmitter 33 which is the sender of the ADV signal Q1 is provided. The beacon ID and the attachment ID are stored in the memory 32.

The other information in the ADV signal Q1 includes vibration information. The vibration information is information relating to the vibration state detected by the vibration sensor 34 of the beacon transmitter 33 which is the sender of the ADV signal Q1, i.e., information relating to the vibration state of the attachment 30 in or on which the beacon transmitter 33 is provided. The vibration information at least includes information indicating whether or not the attachment 30 is vibrating (presence or absence of vibration).

The microcomputer 31 in the beacon transmitter 33 determines whether there is vibration on the attachment 30 based on the detection signal from the vibration sensor 34 and generates vibration information including information indicating whether there is vibration or not at predetermined interval(s). Then, the microcomputer 31 causes the transmitter circuit 37 to transmit, at predetermined interval(s), an ADV signal Q1 indicating the beacon ID and the attachment ID read from the memory 32 and other information such as the vibration information.

Note that the other information of the ADV signal Q1 may include, in addition to or instead of the information above mentioned, for example, specific information regarding the attachment 30 such as the supply volume or supply pressure of hydraulic fluid to the attachment 30, the name (official name), the model number, and/or the serial number of the attachment 30, as well as specific information regarding the beacon transmitter 33 such as the model number, the serial number, and/or the operating state of the beacon transmitter 33.

As illustrated in FIG. 16, the beacon transmitter 33 is located on, for example, the back surface of the attachment 30 that faces the vehicle body 2 of the working vehicle 1. The beacon scanner 23 is located at, for example, the front portion of the vehicle body 2 that faces the attachment 30. The controller 21 is provided in the vehicle body 2. Since the beacon scanner 23 is provided in or on the vehicle body 2, it is possible to achieve a configuration in which output signals from the beacon scanner 23 can be inputted into the controller 21 using simple electric wiring or simple communication circuit(s) as compared to cases where the beacon scanner 23 is provided on the movable working device 4. In the present example, the beacon scanner 23 and the controller 21 are electrically connected together in a wired manner such as using cable(s), but may communicate with each other in a wireless manner, for another example.

The ADV signal Q1 transmitted from the beacon transmitter 33 is received by the beacon scanner 23 of the working vehicle 1. The controller 21 identifies (recognizes) the attachment 30 provided with the beacon transmitter 33 (sender) based on, for example, the attachment ID included in the ADV signal Q1 received by the beacon scanner 23.

In the case where one or more attachments 30 are present in the vicinity of the working vehicle 1, one or more ADV signals Q1 from one or more beacon transmitters 33 in or on the one or more attachments 30 are received by the beacon scanner 23. Upon receipt of each ADV signal Q1, the beacon scanner 23 measures the RSSI of the ADV signal Q1, and outputs information included in the ADV signal Q1 and the RSSI to the controller 21.

The controller 21 causes the internal memory (first memory) 21*a* to store, in its predetermined storage area, information included in the ADV signal Q1 received by the beacon scanner 23 (FIG. 2), thus collecting such information. In so doing, the controller 21 generates advertisement information (hereinafter referred to as "ADV information") including information included in the ADV signal Q1 and time information indicating the receipt time point (date and time) at which the ADV signal Q1 was received, and causes the internal memory 21*a* to store the ADV information in its predetermined storage area. The controller 21 may also include the value indicating the RSSI of the ADV signal Q1 into the ADV information.

FIG. 3 illustrates ADV information stored (collected) in the predetermined storage area of the internal memory 21*a*. In order to keep the capacity of the predetermined storage area of the internal memory 21*a* at a certain level, the controller 21 may delete the ADV information (or overwrite the ADV information with newly generated ADV information) after storing it in the internal memory 21*a* for a period of time. The ADV information includes the foregoing beacon ID, attachment ID, vibration information, RSSI, and time information.

In the case of attaching an attachment 30 on the ground, etc. to the working vehicle 1, while no attachments 30 are attached to the quick hitch 16, i.e., while the latching mechanisms 51 are in the unlatching state, the user of the working vehicle 1 operates the travel operator 6 to cause the traveling devices 5 to travel forward to cause the working device 4 to approach the rear portion of the attachment 30. The user operates the work operator 7 along the first direction to actuate the boom cylinders 14 to raise or lower the booms 11 of the working device 4 so that the height of the quick hitch 16 at the distal end of the booms 11 matches the height of the attachment 30. The user operates the work operator 7 along the second direction to actuate the front cylinders 15 so that the angle (tilt) of the front plates 50*f* of the brackets 50 of the quick hitch 16 matches the angle of the base plate 71 of the attachment 30.

Next, the user operates the travel operator 6 to cause the traveling devices 5 to travel forward to some degree at very low speed to cause the front plates 50*f* of the quick hitch 16 to engage with the base plate 71 of the attachment 30 as illustrated in FIG. 18A, thus causing the brackets 50 to hold the attachment 30. In so doing, the user may, after causing the front plates 50*f* to engage with the base plate 71, use the work operator 7 to raise the booms 11 to some degree or cause the quick hitch 16 to swing upward to some degree to cause the working device 4 to lift up the attachment 30 to some degree to check whether the attachment 30 is held by the brackets 50.

As such, the attachment 30 vibrates, for example, when the front plates 50*f* of the brackets 50 engage with the base plate 71, when the attachment 30 is lifted up by the working device 4, and when the attachment 30 is latched by the latching mechanisms 51. The ADV signal Q1 transmitted from the beacon transmitter 33 in or on the attachment 30 includes vibration information relating to the vibration state of the attachment 30 detected by the vibration sensor 34 when such an instance occurs.

When (i) the latching mechanisms 51 are in the unlatching state and (ii) at least one of the traveling devices 5 or the working device 4 is performing an action to attach an attachment 30, i.e., when an attachment 30 is about to be attached to the working vehicle 1, the beacon scanner 23 receives one or more ADV signals Q1 periodically transmitted from one or more beacon transmitters 33 in or on one or more attachments 30.

When the attachment 30 is attached to the quick hitch 16, the controller 21 performs a selecting process (first selecting process) to select, according to a predetermined condition, the attachment ID included in one of one or more ADV signals Q1 already received by the beacon scanner 23. Specifically, if the attaching switch 26 is operated continuously for the predetermined period Ta1 or more while the latching mechanisms 51 are in the unlatching state, the controller 21 determines that the attachment 30 is attached to the quick hitch 16, and the controller 21 selects, according to a predetermined condition, an attachment ID included in one of the one or more pieces of ADV information stored in the internal memory 21*a*.

Then, the controller 21 regards the selected attachment ID as the attachment ID of the attachment 30 attached to the quick hitch 16, identifies the specifications and/or the like of the attached attachment 30 based on the attachment ID, and performs (starts) a predetermined process based on that attachment ID.

Also when a predetermined switch is operated with the attachment 30 attached to the quick hitch 16, the controller 21 performs a selecting process (second selecting process). In so doing, the controller 21 also selects, according to a predetermined condition, an attachment ID included in one of the one or more pieces of ADV information stored in the internal memory 21*a*, identifies the attached attachment 30 based on the attachment ID, and performs a predetermined process based on the attachment ID. In the present example, the predetermined switch is the attaching switch 26.

For example, the predetermined process performed by the controller 21 includes, in order to indicate that the attachment 30 corresponding to the attachment ID selected via the selecting process is attached to the quick hitch 16 (working vehicle 1), causing the user interface 25 to output (display) information relating to the attachment 30. In so doing, the controller 21 reads, from the internal memory 21*a* as the information relating to the attachment 30, a portion or whole of the ADV information corresponding to the attachment ID selected via the previous selecting process and outputs the read information. Also, the controller 21 reads, from the nonvolatile memory 22 as the information relating to the attachment 30, the information indicating the attachment 30 corresponding to the attachment ID selected via the previous selecting process and outputs the read information.

Another example of the predetermined process is a process in which the controller 21 performs a predetermined control corresponding to the attachment ID selected in the selecting process. Specifically, the controller 21 controls, for example, output of hydraulic fluid (power) to the attachment 30 attached to the quick hitch 16 (controls start and stop of output) according to the attachment ID. It is noted here that the controller 21 may also control at least one of the introduction of hydraulic fluid from the attachment 30, the amount of hydraulic fluid supplied to the attachment 30, or the pressure of hydraulic fluid supplied to the attachment 30.

The working vehicle 1 is switchable between an automatic selection mode and a manual selection mode. The automatic selection mode is a mode in which the controller 21 automatically selects the attachment ID of the attachment 30 attached to the quick hitch 16 and performs a predetermined process based on the selected attachment ID. The manual selection mode is a mode in which the controller 21 performs a predetermined process based on the information indicating the attachment 30 inputted via the user interface 25. That is, in the manual selection mode, the driver of the working vehicle 1 or the like inputs (manually inputs) the information indicating the attachment 30 attached to the quick hitch 16 via the user interface 25.

For example, the manager of the attachment usage system 100 changes the working vehicle to the automatic selection mode or the manual selection mode via the user interface 25 depending on the demand of the driver of the working vehicle 1 or the like. Additionally or alternatively, the controller 21 switches between the automatic selection mode and the manual selection mode as appropriate.

Display data and control data are pre-set for each of the attachment IDs of attachments 30 attachable to the quick hitch 16, i.e., attachments 30 which can be used with the working vehicle 1.

FIG. 4 is a table showing an example of the relationship between the attachment IDs of the attachments 30 attachable to the quick hitch 16 and pieces of display data corresponding to the attachments 30. A piece of display data is data based on which the user interface 25 displays information about a corresponding attachment 30. The display data includes, for example, an icon, name, and specifications of the corresponding attachment 30. Such an attachment ID and display data of the attachment 30 are stored in a predetermined storage area of the nonvolatile memory 22 such that the attachment ID and the display data of the attachment 30 are associated with each other. Note that display data other than that described above may be stored in the nonvolatile memory 22 such that the display data is associated with the attachment ID.

FIG. 5 is a table showing an example of the relationship between the attachment IDs of the attachments 30 attachable to the quick hitch 16 and pieces of control data corresponding to the attachments 30. A piece of control data indicates control performed by the working vehicle 1 according to what attachment 30 is used. The control data includes, for example, the level of the amount of hydraulic fluid supplied to the corresponding attachment 30. Such an attachment ID and control data of the attachment 30 are stored in a predetermined storage area of the nonvolatile memory 22 such that the attachment ID and the control data of the attachment 30 are associated with each other.

The controller 21 performs a predetermined process based on the attachment ID selected in the selecting process and based on the ADV information, the display data, and the control data corresponding to the attachment ID. Note that other control data, such as the value of hydraulic pressure outputted to the attachment 30 and/or the output value of power other than hydraulic fluid, may be stored in the nonvolatile memory 22 such that the control data is associated with the attachment ID.

Figure 6:
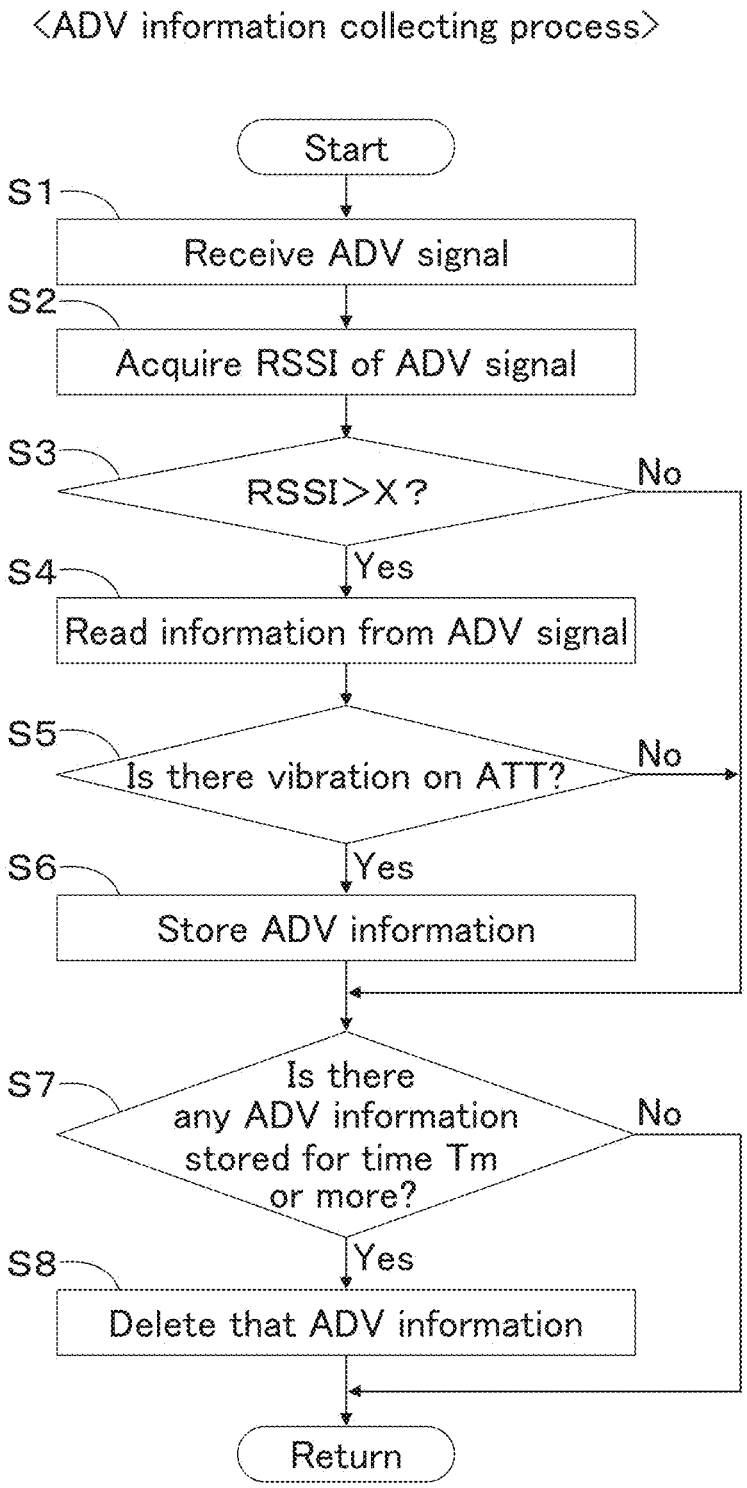
FIG. 6 is a flowchart showing an example of an advertisement information collecting process.

FIG. 6 is a flowchart showing an example of an ADV information collecting process. The ADV information collecting process is repeatedly performed by the controller 21 based on software program(s) stored in the internal memory 21*a* or the nonvolatile memory 22 while the working vehicle 1 is in operation (while the prime mover 9 is being driven). The same applies to the process in FIG. 7 (described later). In the flowchart of FIG. 6, the attachment is referred to as "ATT" for convenience of description. The same applies to the other flowcharts (described later).

While the automatic selection mode is selected, upon receipt of an ADV signal Q1 from the beacon transmitter 33 by the beacon scanner 23 (S1 in FIG. 6), the controller 21 acquires the RSSI of the ADV signal Q1 from the beacon scanner 23 (S2). If the acquired RSSI is greater than a predetermined value X (YES in S3), the controller 21 reads information from the received ADV signal Q1 (S4).

Next, if the information read from the ADV signal Q1 includes vibration information indicating that the attachment 30 is vibrating, the controller 21 determines that there is vibration on the attachment 30 (YES in S5). The controller 21 then generates ADV information (FIG. 3) including information included in the received ADV signal Q1 and the RSSI of the ADV signal Q1, and causes the internal memory 21*a* to store the ADV information (S6 in FIG. 6).

In contrast, if the RSSI of the received ADV signal Q1 is equal to or less than the predetermined value X (NO in S3), the controller 21 does not cause the internal memory 21*a* to store the information included in the received ADV signal Q1 or the RSSI of the ADV signal Q1. Also if the received ADV signal Q1 does not include vibration information indicating that the attachment 30 is vibrating and it is determined that there is no vibration on the attachment 30 (NO in S5), the controller 21 does not cause the internal memory 21*a* to store the information included in the received ADV signal Q1 or the RSSI of the ADV signal Q1.

If any of the pieces of ADV information in the internal memory 21*a* has been stored for a predetermined period of time Tm or more (YES in S7), the controller 21 deletes that piece(s) of ADV information from the internal memory 21*a* (S8). The predetermined period of time Tm is, for example, about 30 seconds which corresponds to at least one of the time for an attachment 30 to be attached to the working vehicle 1 or the time for the attachment 30 to be replaced with another one.

Figure 7A:
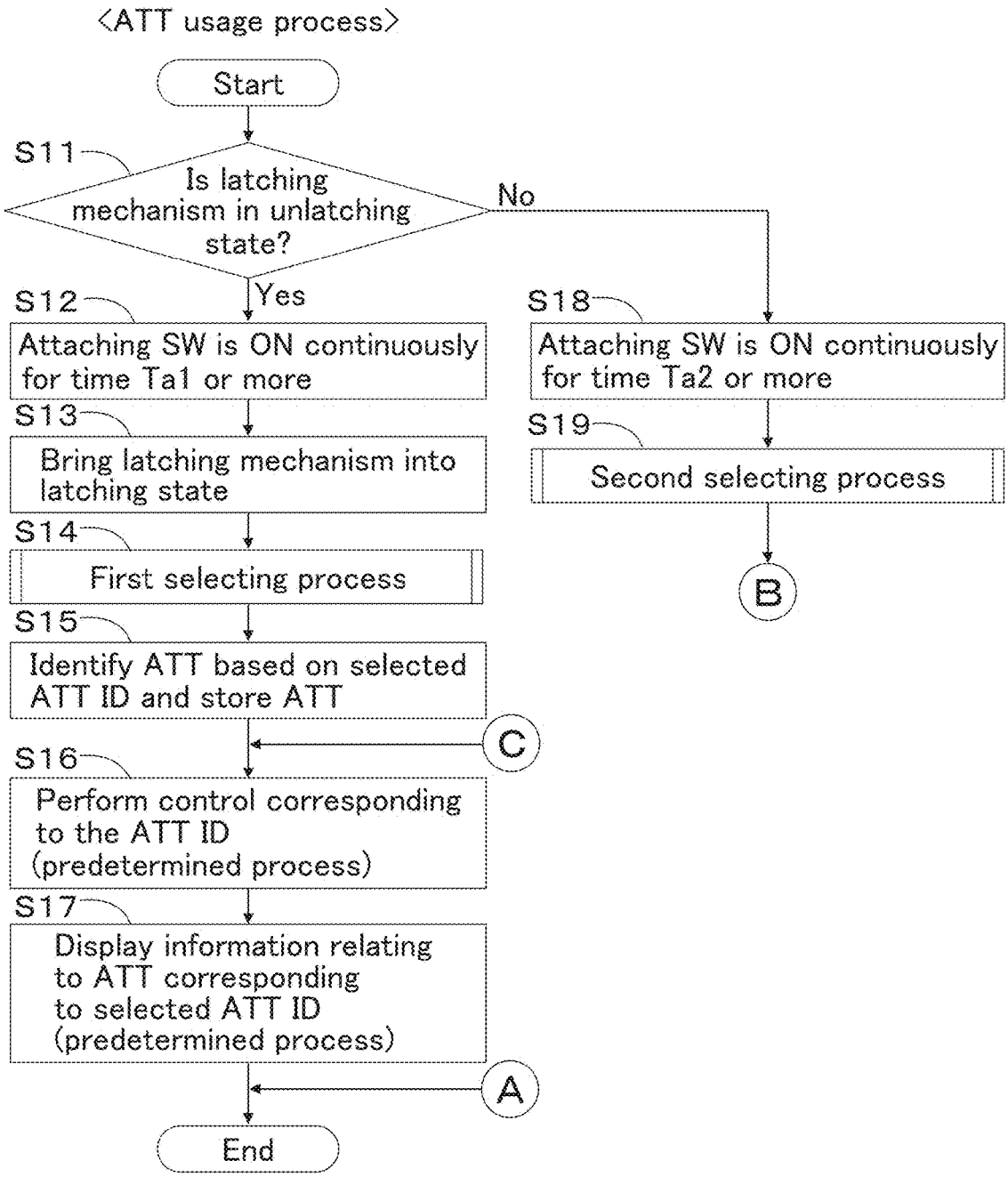
FIG. 7A is a flowchart showing an example of an attachment usage process.
Figure 7B:
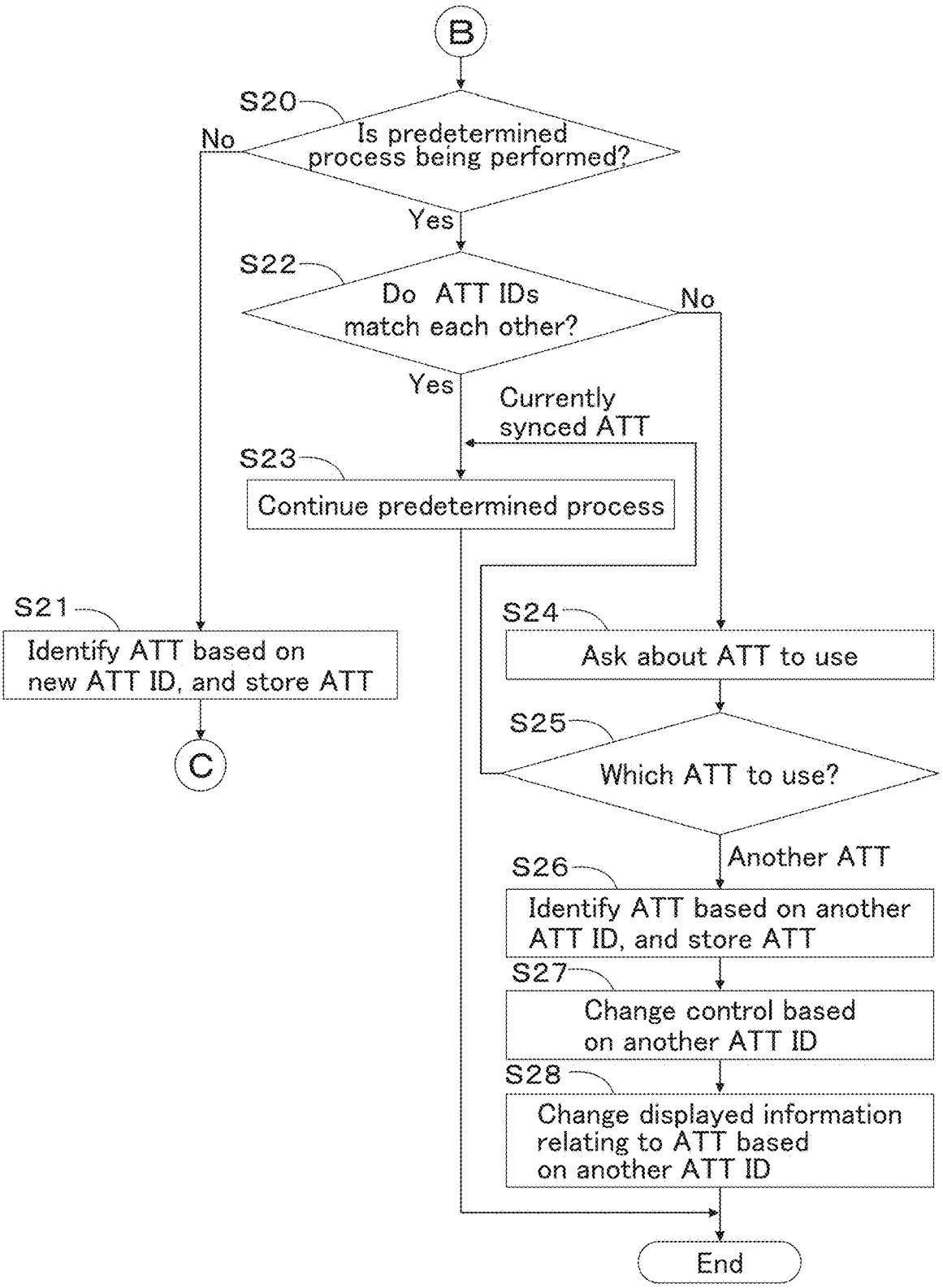
FIG. 7B is a flowchart showing a continuation of FIG. 7A.

FIGS. 7A and 7B are flowcharts showing an example of an attachment usage process. When the controller 21 detects that the latching mechanisms 51 are in the unlatching state (YES at S11 in FIG. 7A), if the attaching switch 26 is operated continuously for the predetermined period Ta1 or more (S12), the controller 21 causes the latch cylinder 52 to extend to a predetermined degree or more to bring the latching mechanisms 51 into the latching state (S13), and performs the first selecting process (S14).

With this, the attachment 30 is attached to the quick hitch 16 and the attachment ID of that attachment 30 is automatically selected. In the present example embodiment, after bringing the latching mechanisms 51 into the latching state at step S13, the controller 21 starts the first selecting process at step S14. Note, however, that as another example, step S13 and step S14 may be started concurrently.

Figure 8:
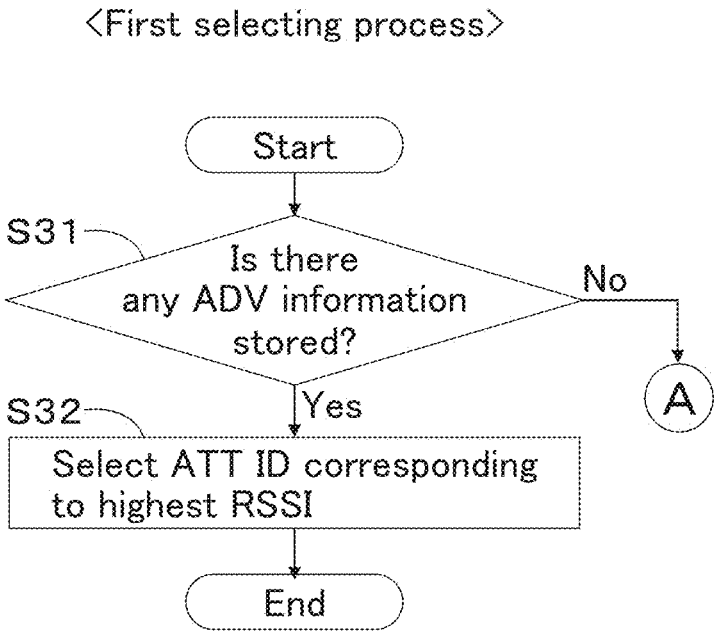
FIG. 8 is a flowchart showing an example of a first selecting process.

FIG. 8 is a flowchart showing an example of a first selecting process. The controller 21, after starting the first selecting process, first checks whether any piece of ADV information is stored in the internal memory 21*a*. In so doing, if one or more pieces of ADV information are stored in the internal memory 21*a* (YES at S31 in FIG. 8), the controller 21 reads the stored one or more pieces of ADV information, detects the highest RSSI, and selects the attachment ID corresponding to that highest RSSI (S32). Step S31 and step S32 are an example of a first condition based on which an attachment ID is selected.

As described above, when the attachment 30 is attached to the quick hitch 16, the controller 21, by performing the first selecting process, automatically selects, according to a first condition, the attachment ID included in one of one or more ADV signals Q1 that were received by the beacon scanner 23 during a period of time Tm which ended when the attachment 30 was attached to the quick hitch 16.

As another example, the first condition may include condition(s) relating to at least one of (i) the number of identical attachment IDs (the number of times the attachment ID has been received) stored in the internal memory 21*a* or (ii) the point(s) in time (receipt time point(s)) at which the signal(s) were received stored in the internal memory 21*a*. For example, the first condition may include (i) a condition in which the attachment ID to be selected is the attachment ID most frequently stored in the internal memory 21*a*, (ii) a condition in which the attachment ID to be selected is the most recently received attachment ID, and/or the like. The first condition may include a combination of at least two of the following: RSSI, the number of identical attachment IDs stored, and the receipt time point. Such conditions are merely examples, and the first condition may include other condition(s).

In the case where the controller 21 has selected one of the attachment IDs at step S32, the controller 21 determines that the selected attachment ID is the attachment ID of the attachment 30 attached to the quick hitch 16. Then, based on the currently selected attachment ID, the controller 21 identifies (recognizes) the attached attachment 30, and causes the nonvolatile memory 22 (which may be the internal memory 21*a*), etc., to store the result of the identification (S15 in FIG. 7A).

Specifically, at step S15, the controller 21 reads the ADV information (FIG. 3) corresponding to the currently selected attachment ID from the internal memory 21*a*, and reads the display data (FIG. 4) and the control data (FIG. 5) corresponding to that attachment ID from the nonvolatile memory 22. Then, based on the read ADV information, display data, and control data, the controller 21 identifies the name, the type and the other specifications of the attached attachment 30.

The controller 21 also performs (starts) control corresponding to the currently selected attachment ID (S16, predetermined process). In so doing, based on the control data corresponding to the currently selected attachment ID read from the nonvolatile memory 22, the controller 21 performs a predetermined control on the working vehicle 1.

Specifically, in the case where the attachment 30 corresponding to the currently selected the attachment ID (i.e., the attachment 30 attached to the quick hitch 16) is an attachment 30*b* including a hydraulic actuator, the controller 21 starts causing the control valve 40*d* to control the output of hydraulic fluid from the hydraulic fluid outlet port 18*a* to the attachment 30*b*, based on the control data read from the nonvolatile memory 22. With this, draining of return fluid to be introduced from the attachment 30*b* into the hydraulic fluid inlet port 18*b* is also started. The controller 21 may, for example, cause a monitor screen G1 to display a message indicating that the control of the output of hydraulic fluid to the attachment 30*b* has been started.

Note that the attachment 30*b* actually starts to be supplied with hydraulic fluid from the hydraulic fluid outlet port 18*a* under control of the controller 21 when the auxiliary output switch 29 (FIG. 1) is turned on. Also, when the auxiliary output switch 29 is turned off, the supply of hydraulic fluid to the attachment 30*b* from the hydraulic fluid outlet port 18*a* is stopped by the controller 21.

On the other hand, in the case where the attachment 30 attached to the quick hitch 16 is an attachment 30 including no hydraulic actuators such as a bucket 30*a*, the controller 21 does not cause the control valve 40*d* to output hydraulic fluid from the hydraulic fluid outlet port 18*a* to the attachment 30 based on the control data read from the nonvolatile memory 22. As another example, the controller 21 may, at step S16 in FIG. 7A, perform control such as adjusting and/or limiting the travel speed and/or speed stage of the working vehicle 1 and/or the height of the raised/lowered booms 11 according to the attachment ID in the selected state.

The controller 21 performs step S16 in FIG. 7A (predetermined control) as described above, and also causes the user interface 25 to display (output) information relating to the attachment 30 corresponding to the currently selected attachment ID (S17 predetermined process). In so doing, the controller 21 extracts information relating to the attached attachment 30 from the ADV information and display data corresponding to the currently selected attachment ID, and causes the user interface 25 to display that information on the monitor screen G1.

Figure 10A:
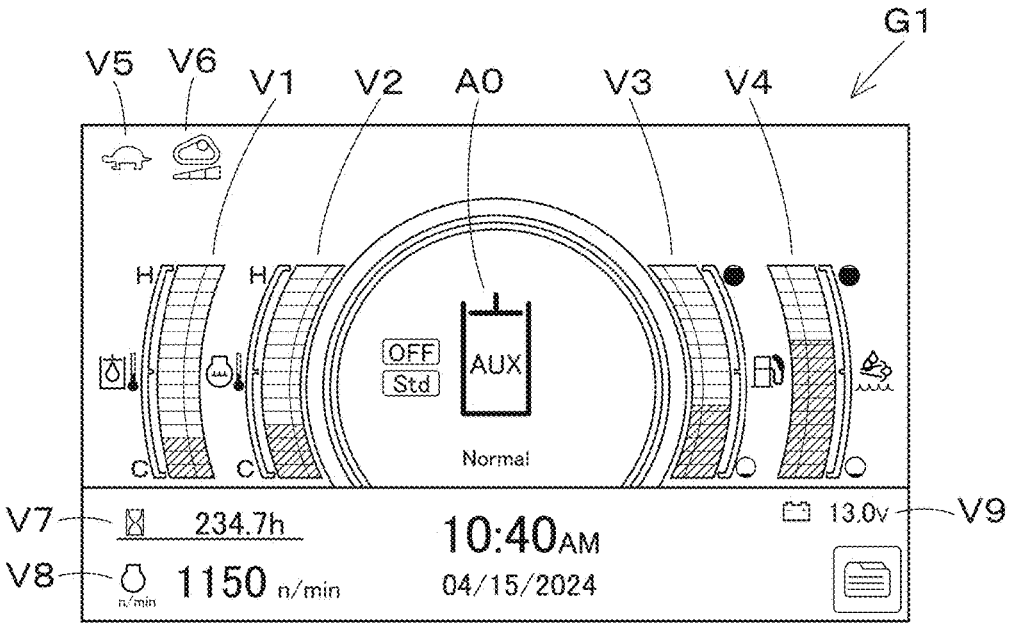
FIG. 10A is a diagram showing an example of a monitor screen before an attachment is attached.
Figure 10B:
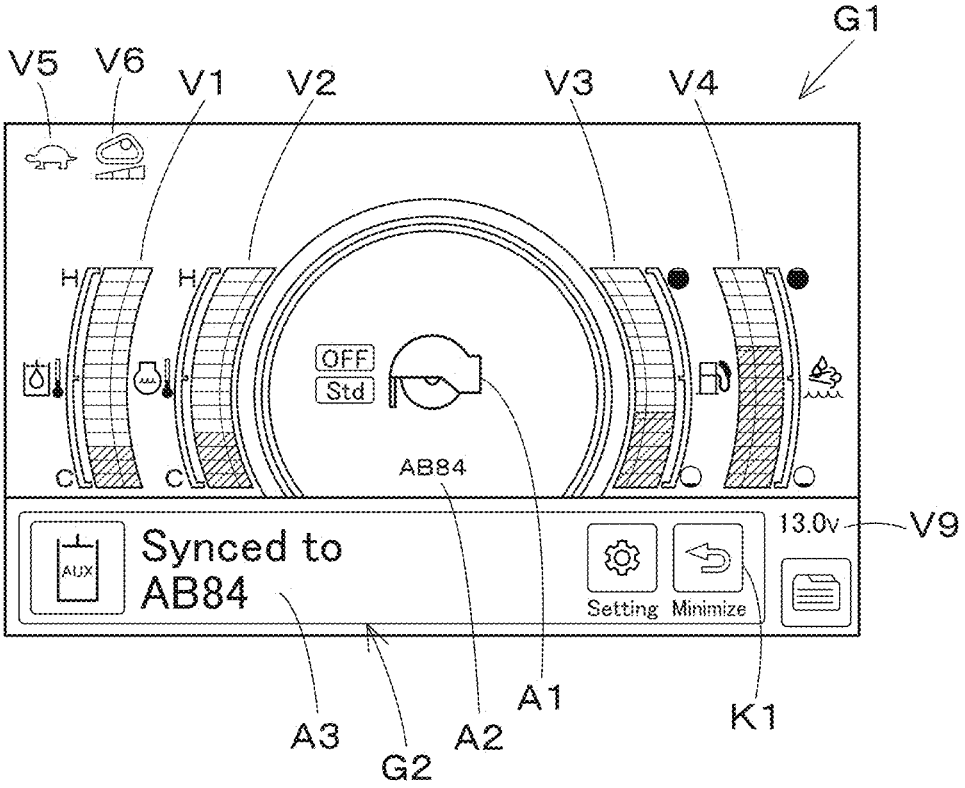
FIG. 10B is a diagram showing an example of a monitor screen displaying information relating to an attachment.

FIGS. 10A and 10B illustrate examples of the monitor screen G1 displayed by the user interface 25. While the working vehicle 1 is in operation, the controller 21 causes the user interface 25 to display the monitor screen G1. Also, the controller 21 causes the monitor screen G1 to display information relating to the state of the working vehicle 1 and/or the current date and time detected by sensors in or on the working vehicle 1. The information relating to the state of the working vehicle 1 includes the temperature V1 of the hydraulic fluid, the temperature V2 of cooling water, the remaining amount V3 of fuel, the remaining amount V4 of aqueous urea solution, the stage V5 of vehicle speed, the magnitude of the load V6 on the traveling devices 5, an hour meter V7 (acting time) of the working vehicle 1, the rotation speed V8 of the prime mover 9 (engine), and the battery voltage V9.

When the latching mechanisms 51 are in the unlatching state and the attachment 30 is not attached to the quick hitch 16, as shown in FIG. 10A, in order to indicate that the central portion of the monitor screen G1 is a display area for the information relating to the attachment 30 which is an auxiliary hydraulic device, the controller 21 displays a default icon A0 in the central portion.

After the latching mechanisms 51 enter the latching state and the attachment 30 is attached to the quick hitch 16, the controller 21 performs step S17 in FIG. 7A, to cause the monitor screen G1 to display pieces of information A1 to A3 relating to the attachment 30 corresponding to the currently selected attachment ID as shown in FIG. 10B.

In the example in FIG. 10B, the pieces of information A1 to A3 relating to the attachment 30 are an icon A1 representing the attachment 30, model number A2, and a message A3 indicating that the controller 21 (working vehicle 1) is synchronized with the attachment 30, which are displayed on the monitor screen G1. More specifically, since the attachment 30 identified is an angle broom, the icon A1 of the angle broom, the model number A2 "AB84" of the angle broom, and the message A3 "Synced to AB84" indicating that the angle broom is synchronized are displayed on the monitor screen G1. The driver (user) of the working vehicle 1 or the like can visually recognize these pieces of information A1 to A3 and can know the attachment 30 automatically identified (recognized) on the working vehicle 1.

The message A3 is displayed in the pop-up window G2. When a certain period of time has passed since the pop-up window G2 was displayed or if a Minimize key K1 in the pop-up window G2 is tapped on, the controller 21 stops displaying the pop-up window G2 (causes the pop-up window G2 to disappear) and displays information such as the date and time, the hour meter V7, the rotation speed V8 of the prime mover 9, and the battery voltage V9, etc. which were hidden by the pop-up window G2 (see FIG. 10A).

As shown in FIG. 10B, after the pieces of information A1 to A3 relating to the attachment 30 start to be displayed on the monitor screen G1, the user turns on an AUX activation switch, which is located in proximity to the seat 8. With this, the controller 21 changes the "OFF" displayed at the center of the monitor screen G1 into "ON", and highlights the icon A1 displayed. In so doing, the controller 21 may start the predetermined control at step S16 in FIG. 7A mentioned earlier.

Information relating to the attachment 30 other than the previously mentioned pieces of information A1 to A3 relating to the attachment 30 may be displayed on the monitor screen G1. For example, the controller 21 may cause the monitor screen G1 to display the name, the type and other specifications of the attachment 30 corresponding to the currently selected attachment ID. Additionally or alternatively, the controller 21 may cause the monitor screen G1 to display information relating to the beacon transmitter 33 corresponding to the currently selected attachment ID (model number, other specifications, etc. of the beacon transmitter 33).

Additionally or alternatively, the controller 21 may transmit the ADV information and display data corresponding to the currently selected attachment ID to a portable device 70 via the communicator 24 (FIG. 1), cause the display of the portable device 70 to display the monitor screen G1, and cause the monitor screen G1 to display information relating to the attachment 30 and/or the like.

On the other hand, in the first selecting process of FIG. 8, in the case where no ADV information is stored in the internal memory 21*a* (NO at S31), the controller 21 cannot select any attachment ID and does not perform step S16 or step S17 in FIG. 7A. Therefore, as shown in FIG. 10A, the information relating to the attachment 30 is not displayed on the monitor screen G1 and the predetermined control for the working vehicle 1 according to the attachment 30 attached to the quick hitch 16 is not performed. In such a case, the controller 21 may cause the monitor screen G1 to display (output) information indicating that the attachment 30 could not be automatically identified (error message).

If the attaching switch 26 is operated continuously for a predetermined period (second period) Ta2 or more while the latching mechanisms 51 are in the latching state (NO at S11 in FIG. 7A) (S18), the controller 21 performs a second selecting process (S19). For example, in order to improve the responsivity of the second selecting process when the attaching switch 26 is operated by the user, the predetermined period Ta2 is shorter than the predetermined period Ta1 (for example, about 1 second). As another example, the predetermined period Ta2 may be the same as the predetermined period Ta1. For example, in order to prevent accidental activation of the second selecting process that would result from a faulty operation of the attaching switch 26, the predetermined period Ta2 may be longer than the predetermined period Ta1.

Figure 9:
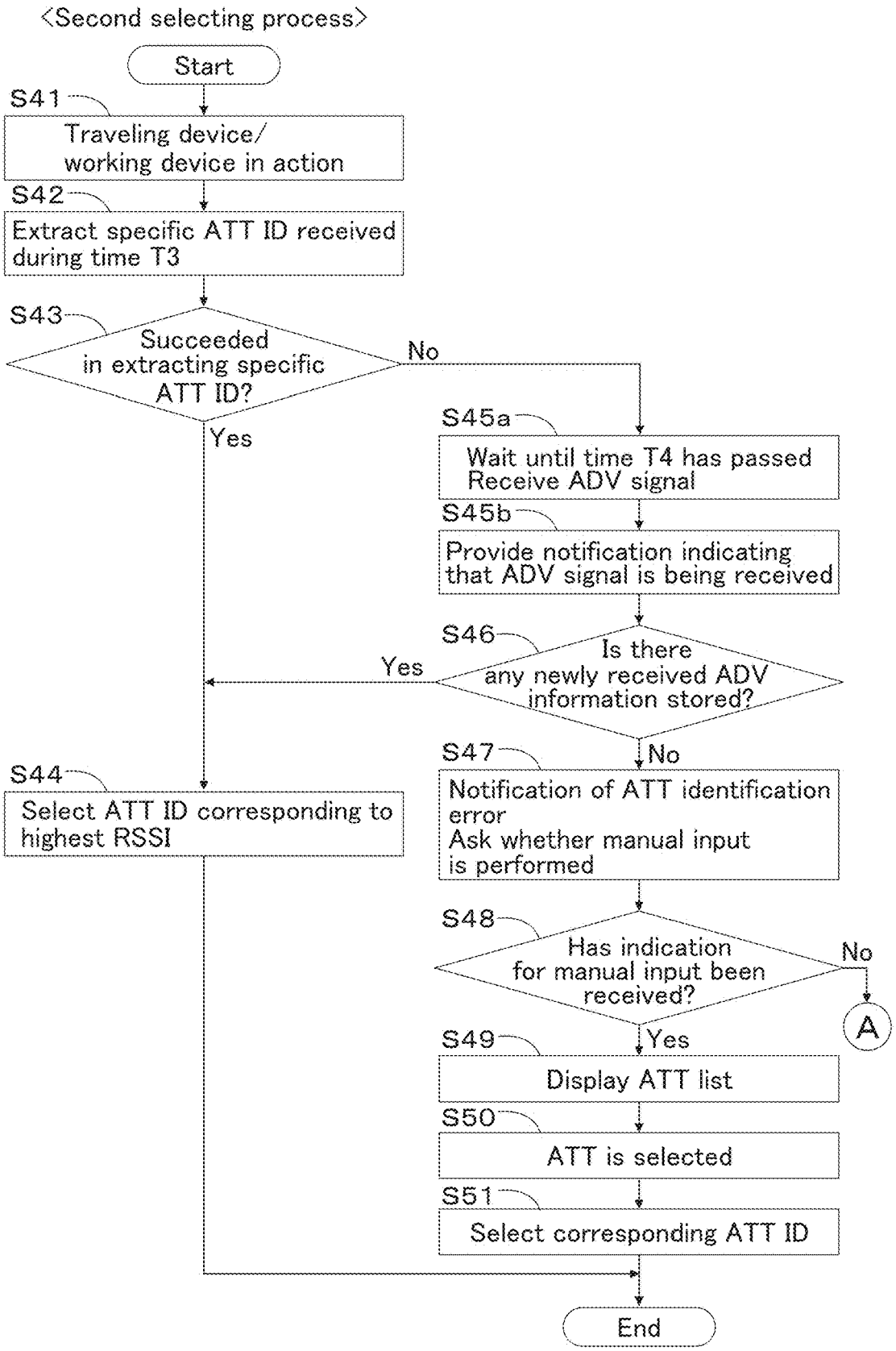
FIG. 9 is a flowchart showing an example of a second selecting process.

FIG. 9 is a flowchart showing an example of the second selecting process. After the controller 21 starts the second selecting process, the controller 21 checks the operating state of the traveling devices 5 and the working device 4. In so doing, if, for example, the controller 21 detects that at least one of the travel operator 6 or the work operator 7 has been continuously operated for a certain period of time or more, the controller 21 determines that at least one of the traveling devices 5 or the working device 4 is in action (S41), and the controller 21 reads information from the internal memory 21*a*.

As another example, the controller 21 may detect whether the traveling devices 5 and the working device 4 are each in action based on output signal(s) from sensor(s) such as acceleration sensor(s) and/or potentiometer(s) in or on the vehicle body 2, the working device 4, and/or the quick hitch 16.

The controller 21 then extracts, from the internal memory 21*a*, specific attachment ID(s) included in one or more ADV signals Q1 which were received by the beacon scanner 23 in a third period T3 (i.e., a first duration) which ended when the attaching switch 26 was operated continuously for the predetermined period Ta2 or more (step S18 in FIG. 7A) (S42).

Specifically, at step S42, the controller 21 first checks whether one or more pieces of ADV information are stored in the internal memory 21*a* and, if one or more pieces of ADV information are stored, the controller 21 reads the time information included in the one or more pieces of ADV information. Then, the controller 21 determines whether the receipt time point indicated by the read time information is included in the first duration, and if the receipt time point is included in the first duration, the controller 21 extracts the attachment ID corresponding to that time information as a specific attachment ID. The third period T3 is, for example, set to about 5 seconds so that the first duration is a duration immediately before the operation of the attaching switch 26.

In the case where the controller 21 succeeded in extracting one or more specific attachment IDs from the internal memory 21*a* (YES at S43), the controller 21 checks the RSSI(s) included in the piece(s) of ADV information corresponding to the extracted one or more specific attachment IDs, and selects the specific attachment ID corresponding to the highest one of the RSSI(s) (S44).

Figure 11:
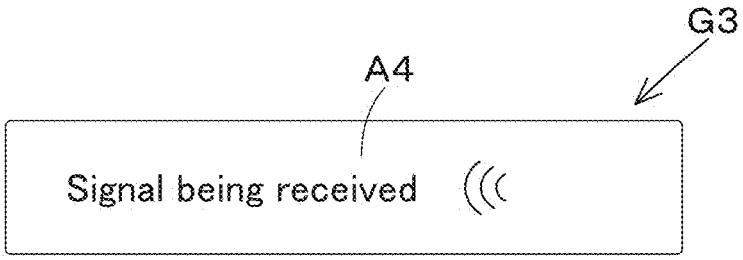
FIG. 11 is a diagram showing an example of a pop-up window providing a notification that advertisement signal(s) is/are being received.

In the case where the controller 21 failed to extract any specific attachment ID from the internal memory 21*a* (NO at S43), the controller 21 waits for a second duration which is a fourth period T4 from the point in time at which the controller 21 failed to extract any specific attachment ID, and allows the beacon scanner 23 to receive ADV signal(s) Q1 (S45*a*). During the second duration, the controller 21 causes the user interface 25 to provide a notification indicating that ADV signals Q1 are being received (S45*b*). In so doing, for example, as shown in FIG. 11, the controller 21 causes a pop-up window G3 to be displayed on the monitor screen G1. The pop-up window G3 includes a message (information) A4 indicating that ADV signals Q1 are being received. The fourth period T4 is set longer (for example, about 7 seconds) than the third period T3 so that ADV signals Q1 are likely to be received during the second duration.

Then, when the fourth period T4 has passed, the pop-up window G3 is caused to disappear from the monitor screen G1. In the case where one or more pieces of ADV information corresponding to one or more ADV signals Q1 newly received during the second duration are stored in the internal memory 21*a* (YES at S46), the controller 21 checks the RSSI(s) included in the one or more pieces of ADV information and newly selects the attachment ID corresponding to the highest one of the RSSI(s) (S44). Steps S41 to S46 are an example of a second condition based on which an attachment ID is selected.

As described above, the controller 21 performs the second selecting process when the attaching switch 26 is operated continuously for the predetermined period Ta2 or more with the attachment 30 attached to the quick hitch 16, thus automatically selecting, according to a second condition, an attachment ID included in one of the one or more ADV signals Q1 received by the beacon scanner 23 immediately before or immediately after the operation of the attaching switch 26. Thus, the second condition includes condition(s) to narrow down the candidate attachment IDs, differently from the first condition based on which the attachment ID is selected from all of the attachment IDs stored in the internal memory 21*a*.

As another example, similarly to the previously mentioned first condition, the second condition may include, in addition to or instead of a condition relating to RSSI, condition(s) relating to at least one of the number of identical attachment IDs or the points in time at which the signals were received, stored in the internal memory 21*a* The second condition may include condition(s) relating to a combination of at least two of the following: RSSI, the number of identical attachment IDs, and the points in time at which the signals were received. Such conditions are merely examples, and the second condition may include other condition(s).

In the case where the internal memory 21*a* stores no ADV information corresponding to the ADV signal(s) Q1 newly received during the second duration after the fourth period T4 has passed (NO at S46), the controller 21 causes the monitor screen G1 to display (output) error information which is a notification indicating that no attachments 30 were automatically identified and information asking whether to manually input the attachment 30 to be used (S47).

Figure 12:
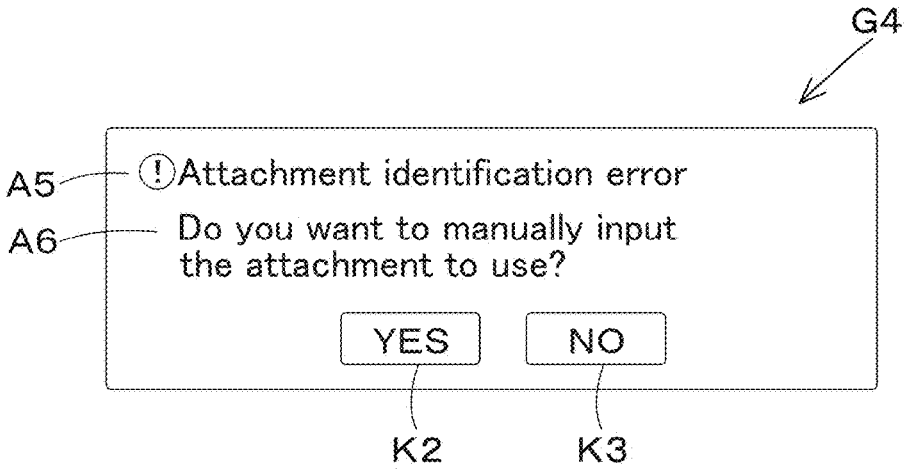
FIG. 12 is a diagram showing an example of a pop-up window asking whether manual input is performed or not.

In so doing, the controller 21 causes the monitor screen G1 to display a pop-up window G4 as shown in FIG. 12, for example. The pop-up window G4 includes an error message A5 indicating an identification error of the attachment 30, a message A6 asking whether or not to manually input the attachment 30 to be used, a YES key K2 and a NO key K3. When the user taps the NO key K3 (to input "NO") to indicate (instruct) not to manually input the attachment 30 to be used (NO at S48), the controller 21 causes the pop-up window G4 to disappear from the monitor screen G1. In such a case, the controller 21 cannot select any attachment ID, and step S16 or step S17 in FIG. 7A is not performed.

When the user taps the YES key K2 (to input "YES") to indicate (instruct) to manually input the attachment 30 to be used (YES at S48), the controller 21 causes the pop-up window G4 to disappear from the monitor screen G1. Then, the controller 21 causes the user interface 25 to display, on the monitor screen G1, an attachment list L1 of a plurality of attachments 30 that can be used on the working vehicle 1 (attachable to the quick hitch 16) (S49).

FIG. 14 shows an example of the attachment list L1. The nonvolatile memory 22 stores data of the attachment list L1. The attachment list L1 includes, for example, attachment information such as name(s), attachment ID(s), and specifications of the attachment(s) 30 which can be used with the working vehicle 1.

The user selects a piece of attachment information relating to the attachment 30 attached to the quick hitch 16 from the attachment list L1 via the user interface 25 (S50 in FIG. 9). With this, the controller 21 selects the attachment ID corresponding to the selected piece of attachment information (S51), and causes the attachment list L1 to disappear from the monitor screen G1.

For example, the controller 21 may cause the user interface 25 to display, in a selectable manner, icon(s) (symbol (s)) of the attachment(s) 30 which can be used with the working vehicle 1, instead of displaying the attachment list L1 in step S49. Alternatively, for example, the controller 21 may cause the user interface 25 to display an input screen to receive input of attachment information such as an attachment ID.

When causing the user interface 25 to display the attachment list L1, the icon(s) of the attachment 30, or the input screen for attachment information, the controller 21 may cause the user interface 25 to also display a prompt message asking for selection or input of the attachment 30 attached to the quick hitch 16.

In the case where the controller 21 has selected one of the attachment ID(s) in the second selecting process, the controller 21 checks whether a predetermined process of steps S16 and S17 in FIG. 7A (predetermined control, output process (display process)) is being performed (being continued). In so doing, in the case where the predetermined process corresponding to the attachment ID previously selected in the already performed first selecting process or second selecting process is not being performed (NO at S20 in FIG. 7B), the controller 21 identifies the attached attachment 30 based on the currently selected attachment ID selected in the most recently performed second selecting process, and causes the nonvolatile memory 22 and/or the like to store the result of the identification (S21). The controller 21 then performs control corresponding to the currently selected attachment ID (S16 in FIG. 7A), and causes the user interface 25 to display information relating to the attachment 30 corresponding to the currently selected attachment ID (S17).

In the case where the controller 21 is currently performing the predetermined process according to the previous attachment ID (YES at S20 in FIG. 7B), the controller 21 checks whether the previous attachment ID and the current attachment ID match each other. In the case where the previous attachment ID and the current attachment ID match each other (YES at S22), the controller 21 continues the currently performed predetermined process (predetermined control, output process) (S23). In such a case, the controller 21 may cause the monitor screen G1 to display information (message, etc.) indicating that the controller 21 has detected the synchronized (recognized) attachment 30 again.

In the case where the previous attachment ID differs from the current attachment ID (NO at S24), the controller 21 causes the user interface 25 to display (output), on the monitor screen G1, information A7 asking whether or not to change the attachment 30 used on the working vehicle 1 from the synchronized attachment 30 corresponding to the previous attachment ID to another attachment 30 corresponding to the currently selected attachment ID (i.e., whether to use the attachment corresponding to the currently selected attachment ID instead of the synchronized attachment 30 corresponding to the previously selected attachment ID) (S24).

Figure 13:
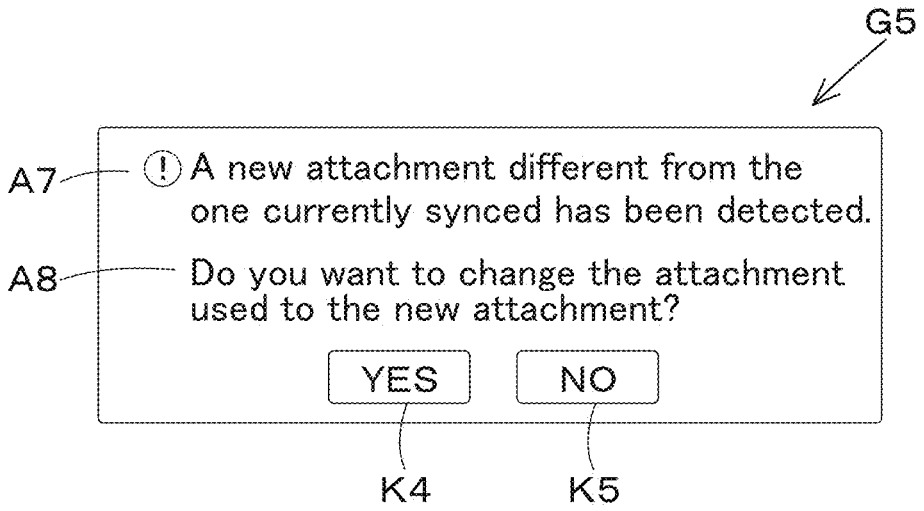
FIG. 13 is a diagram showing an example of a pop-up window asking about the attachment to be used.

In so doing, the controller 21 causes the monitor screen G1 to display a pop-up window G5 as shown in FIG. 13, for example. The pop-up window G5 includes a message A7 indicating that another attachment 30 different from the attachment 30 currently synchronized was detected, a message A8 asking whether or not to change the attachment 30 to be used to the another attachment 30, a YES key K4, and a NO key K5.

When the user taps the NO key K5 in order to keep using the currently synchronized attachment 30 (not to change the currently synchronized attachment 30 to another attachment 30) (S25, currently synchronized ATT), the controller 21 causes the pop-up window G5 to disappear from the monitor screen G1, and continues to perform the currently performed predetermined process and continues to display pieces of information A1 to A3 relating to the currently synchronized attachment 30 (S23).

When the user taps the YES key K4 in order to change the attachment 30 to be used to the another attachment (S25, another ATT), the controller 21 causes the pop-up window G5 to disappear from the monitor screen G1. The controller 21 then identifies the another attachment 30 based on the current attachment ID corresponding to the another attachment 30, and causes the nonvolatile memory 22 and/or the like to store the result of the identification (S26 in FIG. 7A).

Figure 10C:
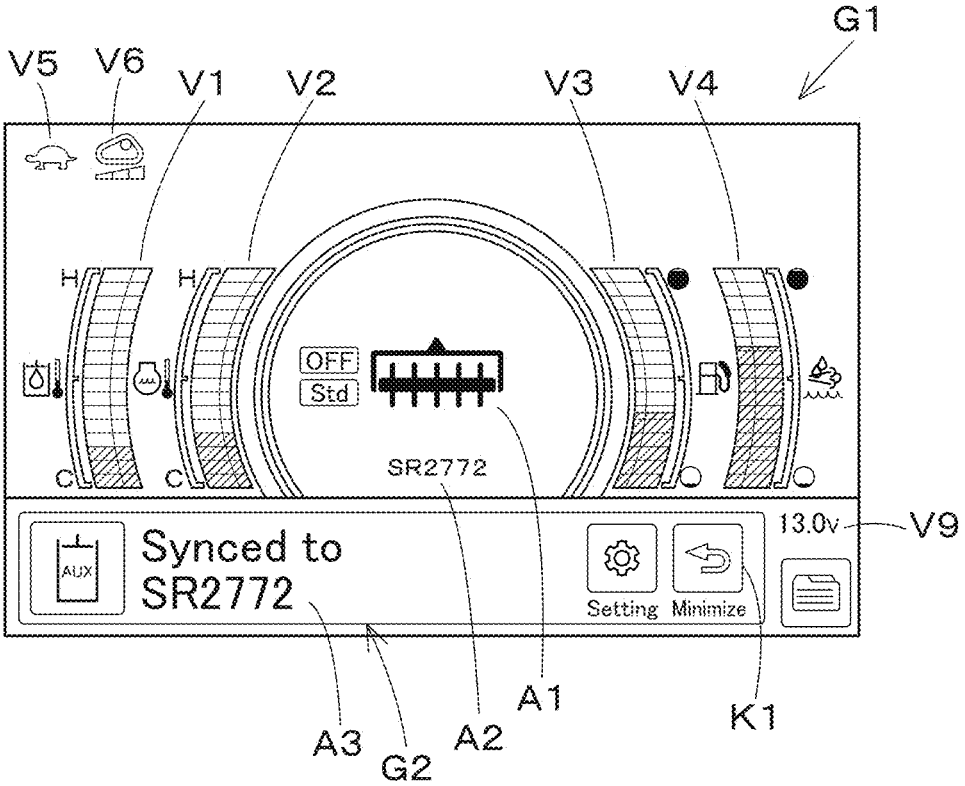
FIG. 10C is a diagram showing an example of a monitor screen displaying information relating to an attachment.

The controller 21 stops the currently performed predetermined control and performs a predetermined control corresponding to the current attachment ID (S27, predetermined process) and, as shown in FIG. 10C, causes the user interface 25 to display pieces of information A1 to A3 relating to the another attachment 30 on the monitor screen G1 (S28, predetermined process). In the example in FIG. 10C, since the another attachment 30 is a rake, the icon A1 of a rake, the model number A2 "SR2772" of the rake, and the message A3 "Synced to SR2772" indicating that the rake is synchronized are displayed on the monitor screen G1.

After that, when the user operates the detaching switch 27 for a predetermined period of time Td or more in order to detach the attachment 30 from the quick hitch 16, the controller 21 causes the latch cylinder 52 to retract to bring the latching mechanisms 51 into the unlatching state, thus allowing the attachment 30 to be detached from the quick hitch 16.

In so doing, in the case where an attachment ID is currently selected and a predetermined control corresponding to the currently selected attachment ID and an output process to output information relating to the attachment 30 corresponding to the currently selected attachment ID are being performed, the controller 21 deselects the attachment ID, stops the synchronization of the attachment 30, and also stops the predetermined control and output process. Furthermore, the controller 21 may delete, from the nonvolatile memory 22, the information of the result of identification of the attachment 30 corresponding to the deselected attachment ID, and may cause the nonvolatile memory 22 to save that information as a history in another storage area.

As previously described, the user operates the attaching switch 26 again with the attachment 30 attached (fastened) to the quick hitch 16, in order to (i) allow the attachment 30 not yet identified (synchronized) to be automatically identified to allow the corresponding predetermined process to be performed (started) or (ii) to allow the attachment 30 to be automatically identified again to allow an appropriate predetermined process to be performed (started) because the already identified attachment 30 may not be the intended attachment 30, etc. The reason (i) is based on the demand that the attachment 30 be more easily identified and the corresponding predetermined process be performed quickly. The reason (ii) is based on the demand that the accuracy of identification for the attachment 30 and the appropriateness of the predetermined process be improved.

In order to meet the demands described above, the controller 21 may change the second condition depending on, for example, whether an attachment ID is already selected or not (in other words, whether the predetermined process is being performed or not), when the attaching switch 26 is operated again with the attachment 30 attached to the quick hitch 16 and the second selecting process is performed.

Figure 15A:
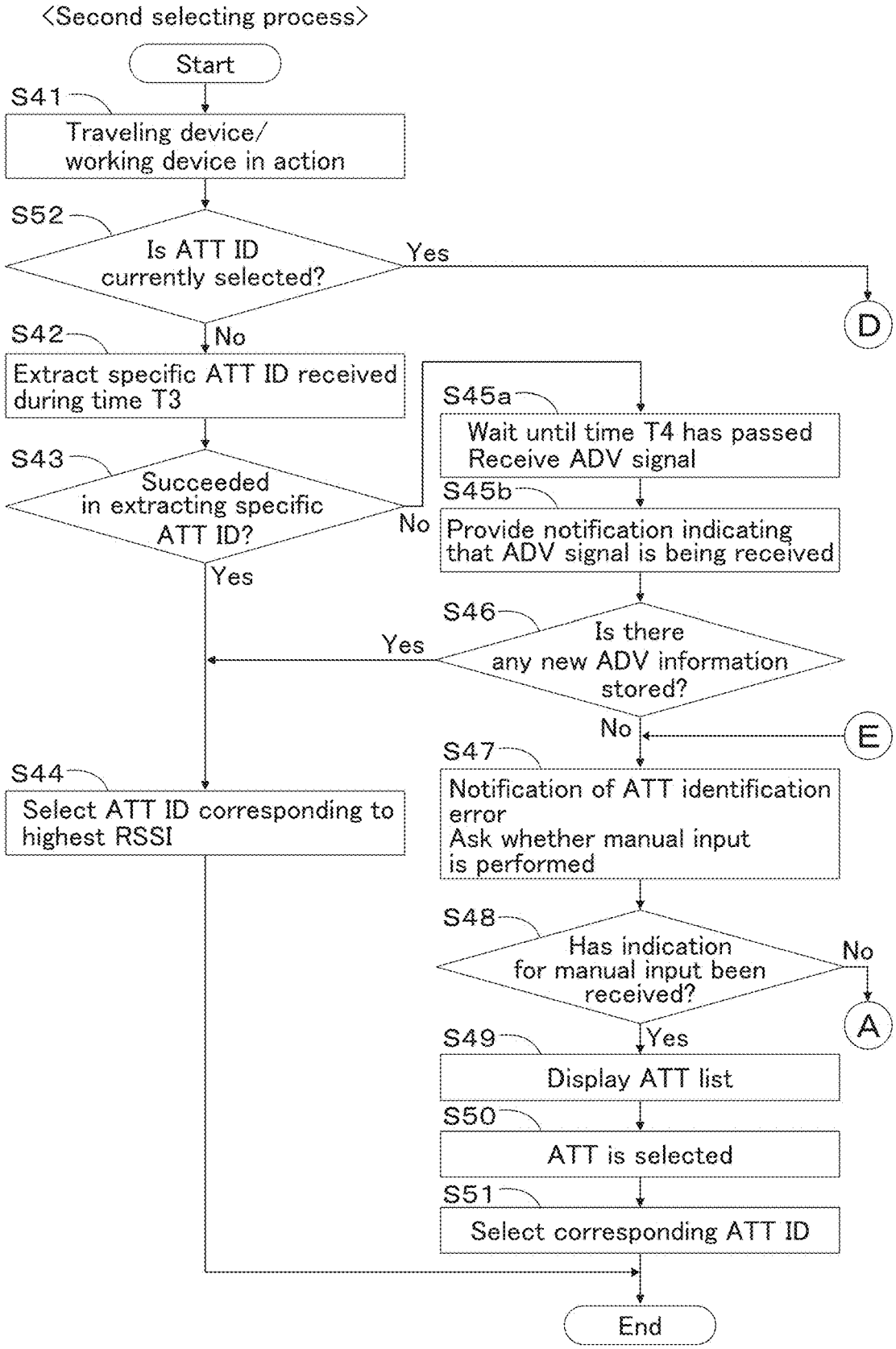
FIG. 15A is a flowchart showing another example of a second selecting process.
Figure 15B:
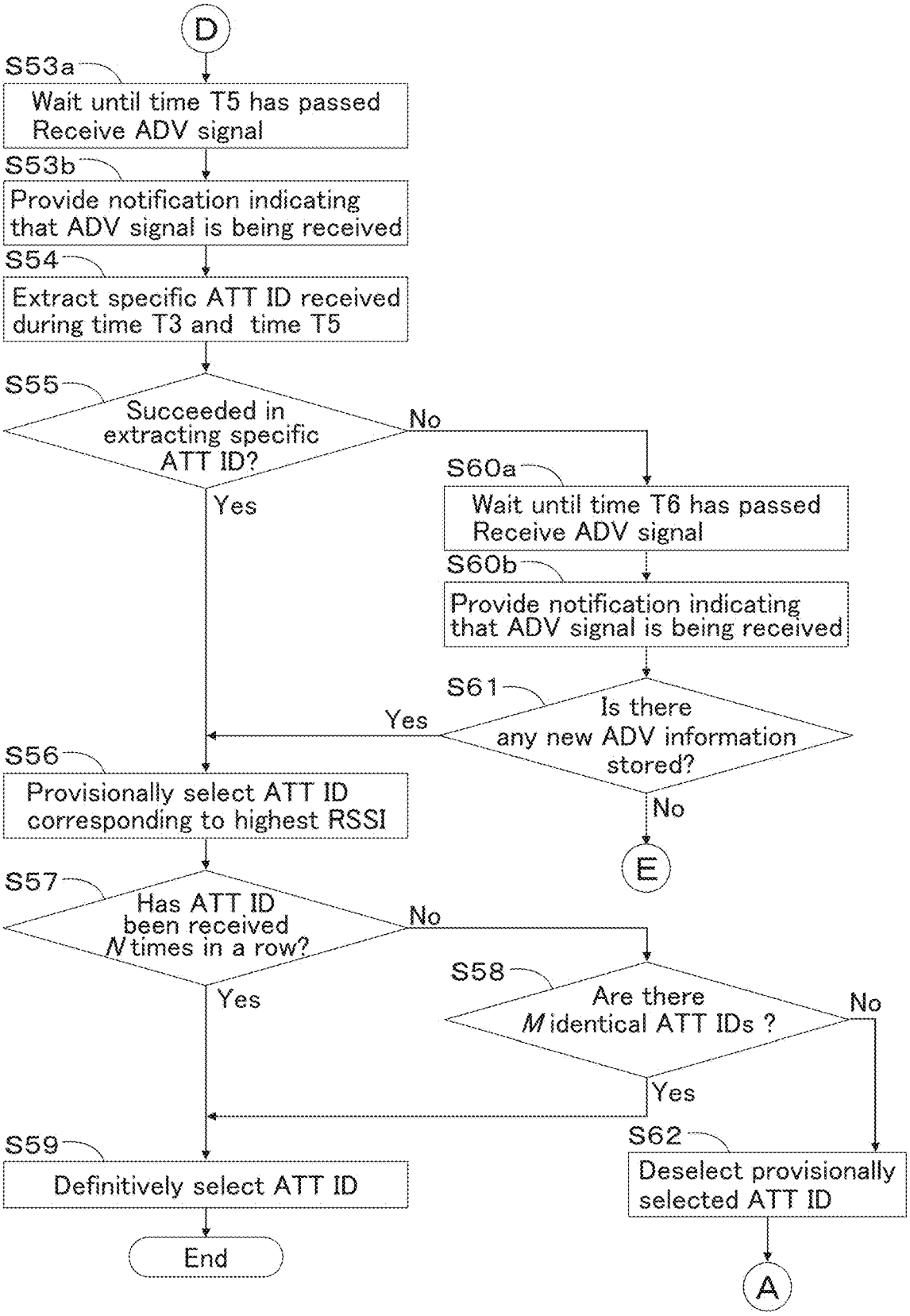
FIG. 15B is a flowchart showing a continuation of FIG. 15A.

FIGS. 15A and 15B are flowcharts showing another example of a second selecting process. The controller 21 determines that at least one of the traveling devices 5 or the working device 4 is currently in action (S41 in FIG. 15A), and if no attachment IDs are currently selected here, (NO at S52), the controller 21 performs steps S42 to S51 as mentioned earlier. Steps S41 to S46 of FIG. 15A are an example of a second condition in the case where no attachment IDs are currently selected.

If an attachment ID is currently selected (YES at S52), the controller 21 waits from that time (current time) onward until a fifth period T5 has passed, and causes the beacon scanner 23 to receive ADV signal(s) Q1 (S53*a* in FIG. 15B) The controller 21 also causes the user interface 25 to display, on the monitor screen G1, information (message) indicating that ADV signal(s) Q1 is/are being received until the fifth period T5 has passed, (S53*b*, see FIG. 11). The fifth period T5 is, for example, about 5 to 7 seconds.

When the fifth period T5 has passed, the controller 21 extracts, from the internal memory 21*a*, specific attachment ID(s) included in one or more ADV signals Q1 which were received by the beacon scanner 23 during a third duration (which is the sum of the third period T3 which ended when the attaching switch 26 was operated continuously for the predetermined period Ta2 or more (step S18 in FIG. 7A) and the fifth period T5 which started when the attaching switch 26 was operated continuously for the predetermined period Ta2 or more) (S54 in FIG. 15B). The third duration is longer than the foregoing first duration and second duration.

In the case where the controller 21 succeeds in extracting one or more specific attachment IDs from the internal memory 21*a* (YES at S55), the controller 21 checks the RSSI(s) included in the piece(s) ADV information corresponding to the extracted specific attachment ID(s), and provisionally selects the specific attachment ID corresponding to the highest RSSI from the attachment ID(s) (S56). The controller 21 then reads time information corresponding to the extracted specific attachment ID from the internal memory 21*a*, and checks whether the provisionally selected attachment ID has been received N times (a predetermined number of times, where N is an integer equal to or more than 2) in a row. If the controller 21 here determines that the provisionally selected attachment ID has been received N times in a row (YES at S57), the controller 21 definitively selects the provisionally selected attachment ID (S59).

If the controller 21 determines that the provisionally selected attachment ID has not been received N times in a row (NO at S57), the controller 21 counts the number of identical attachment IDs including the provisionally selected attachment ID among the extracted specific attachment ID(s). If the controller 21 determines that the number of identical attachment IDs including the provisionally selected attachment ID is M (predetermined number, where M is an integer of 2 or more) or more (YES at S58), the controller 21 definitively selects the provisionally selected attachment ID (S59).

If the controller 21 determines that the number of identical attachment IDs including the provisionally selected attachment ID is not M or more (NO at S58), the controller 21 deselects the provisionally selected attachment ID (S62). With this, the controller 21 cannot select an attachment ID, and does not perform the predetermined process (steps S16, S17 in FIG. 7A).

If the controller 21 fails to extract a specific attachment ID from the internal memory 21*a* (NO at S55), the controller 21 waits for a fourth duration which is a sixth period T6 starting from when the controller 21 failed to extract a specific attachment ID, and causes the beacon scanner 23 to receive ADV signal(s) Q1 (S60*a*). The controller 21 also causes the user interface 25 to display, on the monitor screen G1, a notification A4 (information, message) indicating that ADV signal(s) Q1 is/are being received during the fourth duration (S60*b*, see FIG. 11). The sixth period T6 is a longer time period (for example, about 10 seconds) than the fourth period T4 (for example, about 7 seconds).

After the sixth period T6 has passed, if the internal memory 21*a* stores piece(s) of ADV information corresponding to ADV signal(s) Q1 newly received during the fourth duration (YES at S61), the controller 21 performs step S56 and subsequent steps as described earlier. If the internal memory 21*a* does not store the piece(s) of ADV information (NO at S61), the controller 21 performs step S47 and subsequent steps in FIG. 15A as described earlier.

Step S41 of FIG. 15A and steps S53*a* to S61 of FIG. 15B are an example of a second condition in cases where the attachment ID is currently selected. This second condition includes a condition relating to the RSSI of an ADV signal Q1 (S56), a condition relating to the point in time at which the ADV signal Q1 is received (S41, S53 to S55, S57, S60*a* to S61), and a condition relating to the number of identical attachment IDs (S58). As another example, at least one of steps S41 and S53*a* to S61 may be removed from the second condition.

The second condition in the case where the attachment ID is not currently selected (steps S41 to S46 in FIG. 15A) may include, for example, a condition relating to the number of times an attachment ID has been received sequentially or the number of identical attachment IDs, instead of or in addition to at least one of the condition relating to the RSSI (S44) or the condition relating to the point in time at which the ADV signal Q1 is received (S41 to S43, S45*a* to S46).

As described above, when the controller 21 performs the second selecting process of FIGS. 15A and 15B, if an attachment ID is already selected (YES at S52), the controller 21 waits for a longer period of time to allow more ADV signals Q1 to be received to increase the number of attachment IDs from which an attachment ID is selected, compared to the case where no attachment IDs are selected (NO at S52). That is, when the controller 21 performs the second selecting process, if an attachment ID is already selected, the controller 21 changes the condition (waiting time for reception) relating to the point in time at which each ADV signal Q1 is received, included in the second condition, such that the number of attachment IDs from which an attachment ID is selected is larger than when no attachment IDs are selected.

The second condition set by the controller 21 includes condition(s) relating to at least one of the RSSI of an ADV signal Q1, the point in time at which the ADV signal Q1 is received, or the number of identical attachment IDs included in ADV signals Q1. In this regard, when the controller 21 performs the second selecting process, if an attachment ID is already selected, the second condition set by the controller 21 includes a larger number of the above conditions than when no attachment IDs are selected.

Thus, the controller 21 sets the second condition more strictly in the case where an attachment ID is already selected than in the case where no attachment IDs are selected to improves the accuracy of the selection of the attachment ID of the attachment 30 attached to the quick hitch 16. On the contrary, the controller 21 sets the second condition less strictly in the case where no attachment IDs are selected than in the case where an attachment ID is already selected to increase the likelihood that an attachment ID will be selected.

Note that the above-described manners in which the second condition is set and changed are merely examples, and this does not imply any limitation. When the controller 21 performs the second selecting process, the controller 21 may set and/or change the second condition depending on whether an attachment ID is already selected or not, based on information relating to ADV signal(s) Q1 and/or attachment ID(s) other than the above described information.

In the above-described example embodiments, each attachment 30 is provided with a beacon transmitter 33 to transmit a wireless signal (advertisement signal Q1) compliant with Bluetooth (registered trademark) Low Energy, and the working vehicle 1 is provided with a beacon scanner 23 to receive the wireless signals. However, additionally or alternatively, for example, the attachment 30 may be provided with a transmitter such as a radio frequency identification (RFID) tag, and the working vehicle 1 may be provided with a receiver to receive wireless signals transmitted from the RFID. Additionally or alternatively, the attachment 30 may be provided with a transmitter to transmit radio waves for some other near field communication, and the working vehicle 1 may be provided with a receiver to receive the radio waves.

In the above-described example embodiments, the working vehicle 1 is provided with the quick hitch 16. Alternatively, the working vehicle 1 may be provided with a hitch having a different structure from the quick hitch 16, a quick hitch to which an attachment 30 can be attached and detached both automatically and manually, or a hitch to which an attachment 30 can be attached and detached only manually. In the case where the user manually attaches the attachment 30 to the hitch or manually detaches the attachment 30 from the hitch, the user may input information indicating that the attachment 30 is attached or detached using the user interface 25.

In the above-described example embodiments, the second selecting process is performed when, for example, the attaching switch 26 is operated with the attachment 30 attached to the quick hitch 16. However, the controller 21 may perform the second selecting process when a predetermined operator such as some other switch is operated in a predetermined manner instead of or in addition to the attaching switch 26. Furthermore, the predetermined operator, the switches 26 to 29, the travel operator 6, and the work operator 7 are not limited to hardware operating switches and operating levers, and may be, for example, software keys, etc., on the display screen of the user interface 25.

The controller 21 may use, for example, a portable device 70 external to the working vehicle 1 as an input and an output, instead of or in addition to the user interface 25 in or on the working vehicle 1. In such a case, the controller 21 need only cause the communicator 24 to transmit information to the output external to the working vehicle 1 and cause the output to output the information. A controller such as an information processor external to the working vehicle 1 may perform similar processes to the controller 21. That is, the controller and the output of the attachment usage system 100 may be provided somewhere other than the working vehicle 1.

In the above-described example embodiments, the working device 4, the quick hitch 16, and the specific attachment 30*b* are provided with hydraulic actuators (such as the boom cylinders 14, the front cylinders 15, and the latch cylinder 52). Additionally or alternatively, the working device 4, the quick hitch 16, and the specific attachment may be provided with other actuators such as electric actuators including electric motors or hydraulic actuators other than the hydraulic cylinders. In the case where an attachment including an electric actuator is attached to the quick hitch 16, the controller 21 may output, as power for the electric actuator, electricity (power) from the battery 20 (FIG. 1) to the attachment via an external electric wire based on control data corresponding to the attachment.

An attachment including a work member to be actuated by power from the prime mover 9 of the working vehicle 1 may be attached to the quick hitch 16. In the case where such an attachment including a work member is attached to the quick hitch 16, the controller 21 may output power from the prime mover 9 to the attachment via a power transmission mechanism including gear(s), shaft(s), and/or the like based on control data corresponding to the attachment.

Working vehicles 1 and attachment usage systems 100 according to example embodiments described so far include feature(s) recited in the following item(s) and achieve the following effect(s).

(Item 1) A working vehicle 1 including a hitch (quick hitch) 16 to attach and detach an attachment 30 thereto and therefrom, a receiver (beacon scanner) 23 to receive one or more wireless signals (advertisement signals) Q1 which are transmitted periodically from one or more transmitters (beacon transmitters) 33 in or on one or more of the attachments 30, which include respective one or more pieces of identification information (attachment IDs) of the one or more attachments 30, and which are compliant with a near field communication standard, and a controller 21, wherein the controller 21 is configured or programmed to perform a selecting process and a predetermined process when the attachment 30 is attached to the hitch 16 and when a predetermined operator 26 is operated with the attachment 30 attached to the hitch 16, the selecting process including selecting, according to a predetermined condition, one of the one or more pieces of identification information that is included in one of the one or more wireless signals Q1 received by the receiver 23, the predetermined process corresponding to the one of the one or more pieces of identification information selected in the selecting process. An attachment usage system 100 is a system to perform work using an attachment 30 with a working vehicle 1 and includes the working vehicle 1 and one or more transmitters 33.

With the configuration according to item 1, the controller 21 performs, at user's intended times such as when the user such as the driver of the working vehicle 1 operates the traveling devices 5 and/or the working device 4 to attach an attachment 30 to the hitch 16 and/or when the user operates the operator 26 with the attachment 30 attached to the hitch 16, a selecting process to select identification information of that attachment 30 and a predetermined process corresponding to that attachment 30. This makes it possible for the working vehicle 1 to improve the responsivity of the selecting process and the predetermined process in response to the user operation, and also improve convenience. Furthermore, the user can not only wait for the predetermined process to be performed but also intentionally operate the operator 26, etc., to allow the attachment 30 to be ready for use on the working vehicle 1, making it possible to reduce the likelihood that the user will feel distrustful of the auto-attachment-identifying function of the working vehicle 1 and the attachment usage system 100.

Furthermore, the controller 21 does not need to perform complex signal processing to perform the selecting process and the predetermined process each time the receiver 23 receives a wireless signal Q1 from a transmitter 33 in or on an attachment 30, making it possible to reduce the processing load on the controller 21. Furthermore, while the attachment 30 is attached to the hitch 16, provided that the operator 26 is not operated, the controller 21 does not perform the selecting process or, if the controller 21 has already started the predetermined process, the controller 21 can continue the predetermined process. Thus, it is possible to smoothly perform the predetermined process on the working vehicle 1 without unnecessarily stopping the process. This makes it possible to improve the efficiency of the predetermined process corresponding to the attached attachment 30 on the working vehicle 1. It follows that it is possible to efficiently use the attachment 30 on the working vehicle 1 to perform work.

(Item 2) The working vehicle 1 according to item 1, wherein the operator 26 includes an attaching switch 26 to be operated to attach the attachment 30 to the hitch 16, and the controller 21 is configured or programmed to perform the selecting process when the attaching switch 26 is operated to attach the attachment 30 to the hitch 16 and when the attaching switch 26 is operated with the attachment 30 attached to the hitch 16.

With the configuration according to item 2, since the attaching switch 26 reminds the user of connecting an attachment 30 to the working vehicle 1, the user can intentionally operate the attaching switch 26 to cause the selecting process to be performed appropriately and cause the predetermined process to be performed without accidentally operating other operators to actuate elements of the working vehicle 1 in a wrong manner, making it possible to improve the ease of operation. Furthermore, since it is not necessary to separately provide an operator to be operated to perform the selecting process, it is possible to prevent or reduce an increase in parts count of the working vehicle 1.

(Item 3) The working vehicle 1 according to item 2, wherein the controller 21 is configured or programmed to perform a first selecting process (as the predetermined process) when the attaching switch 26 is operated with no attachments 30 attached to the hitch 16, the first selecting process including selecting, according to a first condition, one of the one or more pieces of identification information that is included in one of the one or more wireless signals Q1 received by the receiver 23, and perform a second selecting process (as the predetermined process) when the attaching switch 26 is operated with the attachment 30 attached to the hitch 16, the second selecting process including selecting, according to a second condition differing from the first condition, one of the one or more pieces of identification information that is included in one of the one or more wireless signals Q1 received by the receiver 23.

With the configuration according to item 3, identification information is selected according to a condition that differs between when an attachment 30 is attached to the hitch 16 and when the attaching switch 26 is operated with an attachment 30 attached to the hitch 16. Therefore, for example, even if the controller 21 fails to select any identification information in the first selecting process, the controller 21 can select identification information in the second selecting process and perform the predetermined process.

(Item 4) The working vehicle 1 according to item 3, wherein the hitch 16 includes a latching mechanism 51 selectively operable in a latching state in which the attachment 30 is secured or an unlatching state in which the attachment 30 is not secured, and an actuator (latch cylinder) 52 to actuate the latching mechanism 51 selectively to the latching state or the unlatching state, and the controller 21 is configured or programmed to, when the attaching switch 26 is operated while the latching mechanism 51 is in the unlatching state, cause the actuator 52 to actuate the latching mechanism 51 to the latching state and perform the first selecting process, and when the attaching switch 26 is operated while the latching mechanism 51 is in the latching state, perform the second selecting process.

With the configuration according to item 4, it is possible, when an attachment 30 is attached (secured) to the hitch 16, to select the identification information of the attachment 30. It is also possible to select the identification information of the attachment 30 by the user operating the attaching switch 26 at any time while the attachment 30 is attached to the hitch 16. This makes it possible to appropriately perform the predetermined process corresponding to the attachment 30 attached to the hitch 16.

(Item 5) The working vehicle 1 according to item 4, wherein the controller 21 is configured or programmed to, when the attaching switch 26 is operated continuously for a first period Ta1 or more while the latching mechanism 51 is in the unlatching state, cause the actuator 52 to actuate the latching mechanism 51 to the latching state and then start the first selecting process.

With the configuration according to item 5, the identification information of the attached attachment 30 can be accurately selected and the predetermined process can be performed appropriately after the attachment 30 is attached to the hitch 16. It is also possible to eliminate or reduce the likelihood that the latching mechanism(s) 51 will be actuated accidentally or the first selecting process will be performed accidentally because of an accidental momentary operation of the attaching switch 26.

(Item 6) The working vehicle 1 according to item 5, wherein the controller 21 is configured or programmed to perform the second selecting process when the attaching switch 26 is operated continuously for a second period Ta2 or more while the latching mechanism 51 is in the latching state, the second period Ta2 being shorter than the first period Ta1.

With the configuration according to item 6, when the latching mechanism(s) 51 is/are in the latching state, i.e., while the attachment 30 is attached to the hitch 16, the controller 21 does not need to wait for the latching mechanism(s) 51 to be actuated, and therefore it is possible to quickly perform the second selecting process in response to the operation of the attaching switch 26 and also possible to improve operability.

(Item 7) The working vehicle 1 according to any one of items 3 to 6, wherein the controller 21 is configured or programmed to cause a memory (internal memory) 21*a* to store, for a period of time Tm, one or more received signal strengths (RSSIs) of the one or more wireless signals Q1 received by the receiver 23 and the one or more pieces of identification information included in the one or more wireless signals Q1 such that the one or more received signal strengths are in association with the one or more pieces of identification information, the first selecting process includes selecting, according to the first condition, one of the one or more pieces of identification information stored in the memory 21*a*, and the second selecting process includes selecting, according to the second condition, one of the one or more pieces of identification information stored in the memory 21*a*.

With the configuration according to item 7, it is possible to cause the memory 21*a* to store, for a period of time Tm, piece(s) of identification information included in the wireless signal(s) Q1 received by the receiver 23, and select a piece of identification information of the attachment 30 attached to the hitch 16 according to a first condition or a second condition from the stored piece(s) of identification information.

(Item 8) The working vehicle 1 according to item 7, wherein the first selecting process to be performed by the controller 21 includes selecting one of the one or more pieces of identification information stored in the memory 21*a* based on at least one of (i) the one or more received signal strengths of the one or more wireless signals Q1 corresponding to the one or more pieces of identification information, (ii) one or more points in time at which the one or more wireless signals Q1 were received, or (iii) the number of identical ones of the one or more pieces of identification information.

With the configuration according to item 8, when an attachment 30 is attached to the hitch 16, the identification information of the attached attachment 30 can be accurately selected, making it possible to appropriately perform the predetermined process corresponding to the attachment 30 on the working vehicle 1.

(Item 9) The working vehicle 1 according to item 7 or 8, wherein the second selecting process to be performed by the controller 21 includes extracting, from the memory 21*a*, one or more specific pieces of identification information included in one or more wireless signals Q1 that were received by the receiver 23 during a third period T3 which ended when the attaching switch 26 was operated, and selecting one of the one or more specific pieces of identification information based on at least one of (i) the one or more received signal strengths of the one or more wireless signals Q1 corresponding to the extracted one or more specific pieces of identification information, (ii) one or more points in time at which the one or more wireless signals Q1 were received, or (iii) the number of identical ones of the extracted one or more specific pieces of identification information.

With the configuration according to item 9, when the attaching switch 26 is operated with the attachment 30 attached to the hitch 16, the piece of identification information of the attachment 30 can be selected accurately from the piece(s) of identification information included in the wireless signal(s) Q1 which was/were received by the receiver 23 during a predetermined duration (first duration) which ended when the attaching switch 26 was operated. This makes it possible to appropriately perform the predetermined process corresponding to the attachment 30 on the working vehicle 1.

(Item 10) The working vehicle 1 according to item 9, wherein the controller 21 is configured or programmed to, if the controller 21 fails to extract any specific piece of identification information from the memory 21*a*, select one of one or more newly received pieces of identification information included in one or more wireless signals Q1 that were newly received by the receiver 23 during a fourth period T4 which started when the controller 21 failed to extract any specific piece of identification information, based on at least one of (i) one or more received signal strengths of the newly received one or more wireless signals Q1, (ii) one or more points in time at which the one or more wireless signals Q1 were newly received, or (iii) the number of identical ones of the one or more newly received pieces of identification information.

With the configuration according to item 10, even if, when the attaching switch 26 is operated with the attachment 30 attached to the hitch 16, the receiver 23 does not receive any wireless signals Q1 during a predetermined duration (first duration) which ends when the attaching switch 26 is operated, it is possible to allow the receiver 23 to newly receive wireless signals Q1 during a predetermined duration (second duration) which starts when the attaching switch 26 is operated. It is then possible to accurately select the piece of identification information of the attachment 30 from the piece(s) of identification information included in the newly received wireless signal(s) Q1, making it possible to appropriately perform the predetermined process corresponding to the attachment 30 on the working vehicle 1.

(Item 11) The working vehicle 1 according to item 10, wherein the controller 21 is configured or programmed to cause a user interface 25 to output, during the fourth period T4, information (message) A4 indicating that one or more wireless signals Q1 are being received.

With the configuration according to item 11, it is possible to allow the user to know that processing for the attachment 30 to be used is being performed on the working vehicle 1, during a fourth period T4 which starts when the user operates the attaching switch 26 with the attachment 30 attached to the hitch 16. This makes it possible to eliminate or reduce the likelihood that the user will feel a sense of uncertainty.

(Item 12) The working vehicle 1 according to any one of items 7 to 11, wherein the controller 21 is configured or programmed to, upon detecting that a received signal strength of a wireless signal Q1 received by the receiver 23 is higher than a predetermined value X and/or that the wireless signal Q1 includes vibration information indicating that the attachment 30 is vibrating, cause the memory 21*a* to store, for the period of time Tm, the received signal strength of the wireless signal Q1 and a piece of identification information included in the wireless signal Q1 such that the received signal strength is in association with the piece of identification information.

With the configuration according to item 12, it is possible to select, from wireless signal(s) Q1 received by the receiver 23, a wireless signal Q1 transmitted from a transmitter 33 in or on an attachment 30 which is present in the vicinity of the working vehicle 1 and which vibrated when attached to the hitch 16, and cause the memory 21*a* to store, for a period of time Tm, the received signal strength of the selected wireless signal Q1 and the piece of identification information included in the selected wireless signal Q1. It is then possible to accurately select the piece of identification information of the attachment 30 attached to the hitch 16 from the piece(s) of identification information stored in the memory 21*a* and appropriately perform the predetermined process corresponding to the attachment 30.

(Item 13) The working vehicle 1 according to item 12, further including a traveling device 5 to cause a vehicle body 2 to travel, and a working device 4 to perform work, wherein the hitch 16 is connected to the working device 4, and the second selecting process to be performed by the controller 21 includes selecting, according to the second condition, one of the one or more pieces of identification information that is included in one of the one or more wireless signals Q1 received by the receiver 23 while at least one of the traveling device 5 or the working device 4 is in action.

With the configuration according to item 13, since the attachment 30 attached to the hitch 16 vibrates in synchronization with the actuation of the traveling device 5 and/or the working device 4, it is possible to ensure that the memory 21*a* stores the received signal strength of the wireless signal Q1 transmitted from the transmitter 33 in or on the attachment 30 and the piece of identification information included in the wireless signal Q1. It is then possible to accurately select the piece of identification information of the attachment 30 attached to the hitch 16 from the piece(s) of identification information stored in the memory 21*a* and appropriately perform the predetermined process corresponding to the attachment 30.

(Item 14) The working vehicle 1 according to any one of items 3 to 13, wherein the controller 21 is configured or programmed to, when performing the second selecting process, change the second condition depending on whether any of the one or more pieces of identification information is already selected.

With the configuration according to item 14, it is possible to use the second condition that differs between (i) when the second selecting process is to be performed under the condition in which the predetermined process corresponding to the already selected piece of identification information is performed on the working vehicle 1 and (ii) when the second selecting process is to be performed under the condition in which no identification information is selected or the predetermined process is not performed, making it possible to change the accuracy of the selection of identification information and the time taken for the second selecting process to be performed, and thus possible to further improve convenience and efficiency.

(Item 15) The working vehicle 1 according to item 14, wherein the controller 21 is configured or programmed to, when performing the second selecting process, if any of the one or more pieces of identification information is already selected, change the second condition such that the number of pieces of identification information from which a piece of identification information is selected is larger than when no identification information is selected.

With the configuration according to item 15, it is possible to accurately select the piece of identification information of the attachment 30 attached to the hitch 16 from a larger number of pieces of candidate identification information in the case where a piece of identification information is already selected when the second selecting process is to be performed than in the case where no identification information is selected when the second selecting process is to be performed. On the contrary, in the case where no identification information is selected when the second selecting process is to be performed, it is possible to quickly select the piece of identification information of the attachment 30 attached to the hitch 16 from a smaller number of pieces of candidate identification information than in the case where a piece of identification information is already selected.

(Item 16) The working vehicle 1 according to item 14 or 15, wherein the second condition set by the controller 21 includes at least one condition relating to at least one of (i) one or more received signal strengths of the one or more wireless signals Q1, (ii) one or more points in time at which the one or more wireless signals Q1 were received, or (iii) the number of identical ones of the one or more pieces of identification information included in the one or more wireless signals Q1, and if any of the one or more pieces of identification information is already selected when the controller 21 performs the second selecting process, the second condition set by the controller 21 includes a larger number of the conditions than when no identification information is selected.

With the configuration according to item 16, it is possible to accurately select the piece of identification information of the attachment 30 attached to the hitch 16 according to a larger number of conditions in the case where a piece of identification information is already selected when the second selecting process is to be performed than in the case where no identification information is selected when the second selecting process is to be performed. On the contrary, in the case where no identification information is selected when the second selecting process is to be performed, it is possible to quickly select the piece of identification information of the attachment 30 attached to the hitch 16 according to a smaller number of conditions than in the case where a piece of identification information is already selected.

(Item 17) The working vehicle 1 according to any of items 1 to 16, wherein the predetermined process to be performed by the controller 21 includes performing control corresponding to the one of the one or more pieces of identification information selected in the selecting process and causing a user interface 25 to output information relating to the attachment 30 corresponding to the one of the one or more pieces of identification information.

With the configuration according to item 17, it is possible to perform control corresponding to the attached attachment 30 on the working vehicle 1 to appropriately use the attachment 30 to perform work. It is also possible to cause the user interface 25 to output information relating to the attached attachment 30 for user's recognition. This allows the user to easily check whether the attachment 30 identified (synchronized) on the working vehicle 1 and the attachment 30 the user wishes to use on the working vehicle 1 are the same or not and determine whether or not to operate the attaching switch 26 again.

(Item 18) The working vehicle 1 according to item 17, wherein the controller 21 is configured or programmed to, if the currently selected one of the one or more pieces of identification information selected in the selecting process differs from a previously selected one of the one or more pieces of identification information that had been selected until the selecting process was performed, cause the user interface 25 to output information A8 asking whether to use the attachment 30 corresponding to the currently selected one of the one or more pieces of identification information instead of a previous attachment 30 corresponding to the previously selected one of the one or more pieces of identification information, and if an instruction to use the attachment 30 corresponding to the currently selected one of the one or more pieces of identification information is inputted via the user interface 25, perform the control corresponding to the currently selected one of the one or more pieces of identification information and cause the user interface 25 to output the information A7 relating to the attachment 30 corresponding to the currently selected one of the one or more pieces of identification information.

With the configuration according to item 18, it is possible to eliminate or reduce the likelihood that the attachment 30 identified (synchronized) on the working vehicle 1 will be changed against the user's intent, and also possible to eliminate or reduce the likelihood that the user will feel a sense of uncertainty. It is also possible to appropriately perform, on the working vehicle 1, the predetermined process corresponding to the attachment 30 that the user wishes to use.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working vehicle comprising:

a hitch to attach and detach one of one or more attachments selectively thereto and therefrom;

a receiver to receive one or more wireless signals which are transmitted periodically from one or more transmitters in or on the one or more attachments, which include respective one or more pieces of identification information of the one or more attachments or one or more pieces of identification information of the one or more transmitters, and which are compliant with a near field communication standard;

an attaching switch to be operated to attach one of the one or more attachments selectively to the hitch; and a controller including a computer having a processor and a memory; wherein the controller is configured or programmed to:

perform a first selecting process when the attaching switch is operated with no attachments attached to the hitch, and a first predetermined process when the attachment is attached to the hitch and when the attaching switch is operated with the attachment attached to the hitch, the first selecting process including selecting, according to a first predetermined condition, one of the one or more pieces of identification information that is included in one of the one or more wireless signals received by the receiver; and perform a second selecting process when the attaching switch is operated with the one of the attachments attached to the hitch, and a second predetermined process corresponding to the one of the one or more pieces of identification information selected in the second selecting process, the second selecting process including selecting, according to a second condition differing from the first condition, the one of the one or more pieces of identification information that is included in one of the one or more wireless signals received by the receiver.

2. The working vehicle according to claim 1, wherein the hitch includes:

a latching mechanism selectively operable in a latching state in which one of the one or more attachments is secured or an unlatching state in which any of the one or more attachments is not secured; and an actuator to actuate the latching mechanism selectively to the latching state or the unlatching state; and the controller is configured or programmed to:

when the attaching switch is operated while the latching mechanism is in the unlatching state, cause the actuator to actuate the latching mechanism to the latching state and perform the first selecting process; and when the attaching switch is operated while the latching mechanism is in the latching state, perform the second selecting process.

3. The working vehicle according to claim 2, wherein the controller is configured or programmed to, when the attaching switch is operated continuously for a first period or more while the latching mechanism is in the unlatching state, cause the actuator to actuate the latching mechanism to the latching state and then start the first selecting process.

4. The working vehicle according to claim 3, wherein the controller is configured or programmed to perform the second selecting process when the attaching switch is operated continuously for a second period or more while the latching mechanism is in the latching state, the second period being shorter than the first period.

5. The working vehicle according to claim 1, wherein the controller is configured or programmed to cause a memory to store, for a period of time, one or more received signal strengths of the one or more wireless signals received by the receiver and the one or more pieces of identification information included in the one or more wireless signals such that the one or more received signal strengths are in association with the one or more pieces of identification information;

the first selecting process includes selecting, according to the first condition, one of the one or more pieces of identification information stored in the memory; and the second selecting process includes selecting, according to the second condition, one of the one or more pieces of identification information stored in the memory.

6. The working vehicle according to claim 5, wherein the first selecting process to be performed by the controller includes selecting one of the one or more pieces of identification information stored in the memory based on at least one of (i) the one or more received signal strengths of the one or more wireless signals corresponding to the one or more pieces of identification information, (ii) one or more points in time at which the one or more wireless signals were received, or (iii) a number of identical ones of the one or more pieces of identification information.

7. The working vehicle according to claim 5, wherein the second selecting process to be performed by the controller includes extracting, from the memory, one or more specific pieces of identification information included in one or more wireless signals that were received by the receiver during a third period which ended when the attaching switch was operated, and selecting one of the one or more specific pieces of identification information based on at least one of (i) the one or more received signal strengths of the one or more wireless signals corresponding to the extracted one or more specific pieces of identification information, (ii) one or more points in time at which the one or more wireless signals were received, or (iii) a number of identical ones of the extracted one or more specific pieces of identification information.

8. The working vehicle according to claim 7, wherein the controller is configured or programmed to, when the controller fails to extract any specific piece of identification information from the memory, select one of one or more newly received pieces of identification information included in one or more wireless signals that were newly received by the receiver during a fourth period which started when the controller failed to extract any specific piece of identification information, based on at least one of (i) one or more received signal strengths of the newly received one or more wireless signals, (ii) one or more points in time at which the one or more wireless signals were newly received, or (iii) a number of identical ones of the one or more newly received pieces of identification information.

9. The working vehicle according to claim 8, wherein the controller is configured or programmed to cause a user interface to output, during the fourth period, information indicating that one or more wireless signals are being received.

10. The working vehicle according to claim 5, wherein the controller is configured or programmed to, upon detecting that a received signal strength of a wireless signal received by the receiver is higher than a predetermined value and/or that the wireless signal includes vibration information indicating that a corresponding one of the one or more attachments is vibrating, cause the memory to store, for the period of time, the received signal strength of the wireless signal and a piece of identification information included in the wireless signal such that the received signal strength is in association with the piece of identification information.

11. The working vehicle according to claim 10, further comprising:

a traveling device to cause a vehicle body to travel; and a working device to perform work; wherein the hitch is connected to the working device; and the second selecting process to be performed by the controller includes selecting, according to the second condition, one of the one or more pieces of identification information that is included in one of the one or more wireless signals received by the receiver while at least one of the traveling device or the working device is operating.

12. The working vehicle according to claim 1, wherein the controller is configured or programmed to, when performing the second selecting process, change the second condition depending on whether any of the one or more pieces of identification information is already selected.

13. The working vehicle according to claim 12, wherein the controller is configured or programmed to, when performing the second selecting process, when any of the one or more pieces of identification information is already selected, change the second condition such that a number of pieces of identification information from which a piece of identification information is selected is larger than when no identification information is selected.

14. The working vehicle according to claim 12, wherein the second condition set by the controller includes at least one condition relating to at least one of (i) one or more received signal strengths of the one or more wireless signals, (ii) one or more points in time at which the one or more wireless signals were received, or (iii) a number of identical ones of the one or more pieces of identification information included in the one or more wireless signals; and when any of the one or more pieces of identification information is already selected when the controller performs the second selecting process, the second condition set by the controller includes a larger number of the at least one condition than when no identification information is selected.

15. The working vehicle according to claim 1, wherein the first and second predetermined processes to be performed by the controller includes performing control corresponding to the one of the one or more pieces of identification information selected in the first and second selecting processes and causing a user interface to output information relating to one of the one or more attachments that corresponds to the one of the one or more pieces of identification information selected in the first and second selecting processes, respectively.

16. The working vehicle according to claim 15, wherein the controller is configured or programmed to:

when the one of the one or more pieces of identification information selected in the second selecting process differs from the one of the one or more pieces of identification information that had been selected in the first selecting process, cause the user interface to output information asking whether to use the one of the one or more attachments that corresponds to the one of the one or more pieces of identification information selected in the second selecting process instead of the one of the one or more attachments that corresponds to the one of the one or more pieces of identification information selected in the first selecting process; and when an instruction to use the one of the one or more attachments that corresponds to the one of the one or more pieces of identification information selected in the second selecting process is inputted via the user interface, perform the control corresponding to the one of the one or more pieces of identification information selected in the second selecting process and cause the user interface to output the information relating to the one of the one or more attachments that corresponds to the one of the one or more pieces of identification information selected in the second selecting process.

17. An attachment usage system to perform work using one of one or more attachments with a working vehicle, the attachment usage system comprising:

the working vehicle; and one or more transmitters in or on the one or more attachments to periodically transmit one or more wireless signals which include respective one or more pieces of identification information of the one or more of the one or more attachments or identification information of the one or more transmitters and which are compliant with a near field communication standard; wherein the working vehicle includes:

a hitch to attach and detach one of the one or more attachments selectively thereto and therefrom; and a receiver to receive the one or more wireless signals transmitted from the one or more transmitters;

an attaching switch to be operated to attach one of the one or more attachments selectively to the hitch; and a controller including a computer having a processor and a memory; wherein the controller is configured or programmed to:

perform a first selecting process when the attaching switch is operated with no attachments attached to the hitch, and a first predetermined process when the attachment is attached to the hitch and when the attaching switch is operated with the attachment attached to the hitch, the first selecting process including selecting, according to a first predetermined condition, one of the one or more pieces of identification information that is included in one of the one or more wireless signals received by the receiver; and perform a second selecting process when the attaching switch is operated with the one of the attachments attached to the hitch, and a second predetermined process corresponding to the one of the one or more pieces of identification information selected in the second selecting process, the second selecting process including selecting, according to a second condition differing from the first condition, the one of the one or more pieces of identification information that is included in one of the one or more wireless signals received by the receiver.

* * * * *